US010361514B2

(12) United States Patent
Valenti et al.

(10) Patent No.: US 10,361,514 B2
(45) Date of Patent: Jul. 23, 2019

(54) COMMUNICATION CONNECTORS UTILIZING MULTIPLE CONTACT POINTS

(71) Applicant: PANDUIT CORP., Tinley Park, IL (US)

(72) Inventors: Joshua A. Valenti, Ferndale, MI (US); Sean W. Lenz, Countryside, IL (US); Paul W. Wachtel, Arlington Heights, IL (US); Robert E. Fransen, Orland Park, IL (US); Satish I. Patel, Roselle, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 15/904,620

(22) Filed: Feb. 26, 2018

(65) Prior Publication Data

US 2018/0254586 A1 Sep. 6, 2018

Related U.S. Application Data

(60) Provisional application No. 62/465,984, filed on Mar. 2, 2017.

(51) Int. Cl.

| | |
|---|---|
| ***H01R 13/6461*** | (2011.01) |
| ***H01R 24/64*** | (2011.01) |
| ***H01R 13/26*** | (2006.01) |
| ***H01R 13/6581*** | (2011.01) |
| ***H01R 12/58*** | (2011.01) |

(Continued)

(52) U.S. Cl.

CPC ..... *H01R 13/6461* (2013.01); *H01R 12/585* (2013.01); *H01R 13/26* (2013.01); *H01R 13/6466* (2013.01); *H01R 13/6581* (2013.01); *H01R 24/64* (2013.01); *H01R 2107/00* (2013.01)

(58) Field of Classification Search

CPC H01R 13/6461; H01R 13/26; H01R 13/6581; H01R 12/585

USPC ..... 439/676

See application file for complete search history.

(56) References Cited

U.S. PATENT DOCUMENTS 6,089,923 A * 7/2000 Phommachanh .... H05K 1/0228 439/676

6,409,547 B1 * 6/2002 Reede ..... H01R 13/6464 439/676

(Continued)

*Primary Examiner* — Tulsidas C Patel

*Assistant Examiner* — Peter G Leigh

(74) *Attorney, Agent, or Firm* — Christopher S. Clancy; Jaames H. Williams; Tina Thomas

(57) ABSTRACT

Disclosed herein are various communications systems allowing for multiple contacts points between plug contacts in a communications plug and plug interface contacts (PICs) in a communications jack. In some disclosed implementations, a communications plug including a first and a second plug contact mated with a communications jack having a first and a second plug PIC may form a plurality of plug/jack interfaces. The plug/jack interfaces may form multiple current paths between the communications plug and the communications jack. When a signal propagates between the communications plug and the communications jack, it may be split in the communications plug between a first current path and a second current path, and recombined in the communications jack after traveling through the plurality of plug/jack interfaces.

15 Claims, 41 Drawing Sheets

(51) Int. Cl.
*H01R 13/6466* (2011.01)
*H01R 107/00* (2006.01)

(56) References Cited

U.S. PATENT DOCUMENTS 6,468,097 B1 * 10/2002 Bernstein ..... H01R 13/6485 439/108
6,790,097 B1 * 9/2004 Edwards ..... H01R 13/6485 439/181
7,074,092 B1 * 7/2006 Green ..... H01R 13/719 439/676
7,614,905 B2 * 11/2009 Shen ..... H01R 13/7172 439/490
7,682,203 B1 * 3/2010 Pharney ..... H01R 13/6658 439/676
7,874,849 B2 * 1/2011 Sticker ..... H01R 24/64 439/404
7,874,877 B2 * 1/2011 Caveney ..... H01R 13/6658 439/676
7,914,346 B2 * 3/2011 Pharney ..... H01R 13/6658 439/676
7,967,644 B2 * 6/2011 Pepe ..... H01R 13/02 439/676
7,976,349 B2 * 7/2011 Heckmann ..... A61F 2/4081 439/676
7,980,901 B2 * 7/2011 Caveney ..... H01R 13/6658 439/676
8,308,509 B2 * 11/2012 Karam ..... H01R 9/035 439/579
8,632,368 B2 * 1/2014 Pepe ..... H01R 13/02 439/676
8,650,750 B2 * 2/2014 Engels ..... H01R 4/2433 29/857
8,894,446 B2 * 11/2014 Feldner ..... H01R 12/727 439/676
9,203,195 B2 * 12/2015 Mueller ..... H01R 13/516
9,246,274 B2 * 1/2016 Valenti ..... H01R 13/6466
9,263,821 B2 * 2/2016 Pepe ..... H01R 13/02
9,368,913 B2 * 6/2016 Saito ..... H01R 13/506
2008/0146093 A1 * 6/2008 Caveney ..... H01R 13/6658 439/890
2012/0244752 A1 * 9/2012 Patel ..... H01R 13/6466 439/620.22
2014/0273570 A1 * 9/2014 Fransen ..... H01R 24/64 439/174
2015/0349463 A1 * 12/2015 Patel ..... H01R 13/6466 439/620.09
2016/0079710 A1 * 3/2016 Schumacher ..... H01R 13/6466 439/620.21

* cited by examiner

COMMUNICATION CONNECTORS UTILIZING MULTIPLE CONTACT POINTS

CROSS-REFERENCE TO RELATED APPLICATIONS

This application claims the benefit of priority to U.S. Provisional Patent Application No. 62/465,984, filed on Mar. 2, 2017, the entirety of which is incorporated herein by reference.

BACKGROUND

Network communications have come to rely heavily on twisted pair cables, and RJ45 plug and jacks which enable connectivity. RJ45 plug and jacks are designed to mate together by way of plug contacts within the plug and plug interface contacts (PICs) within the jack. When plug contacts of an RJ45 plug contact the PICs of an RJ45 jack, data can flow through the mated plug/jack combination.

BRIEF DESCRIPTION OF THE DRAWINGS

The following detailed description references the drawings, wherein.

DETAILED DESCRIPTION

Figure 1:
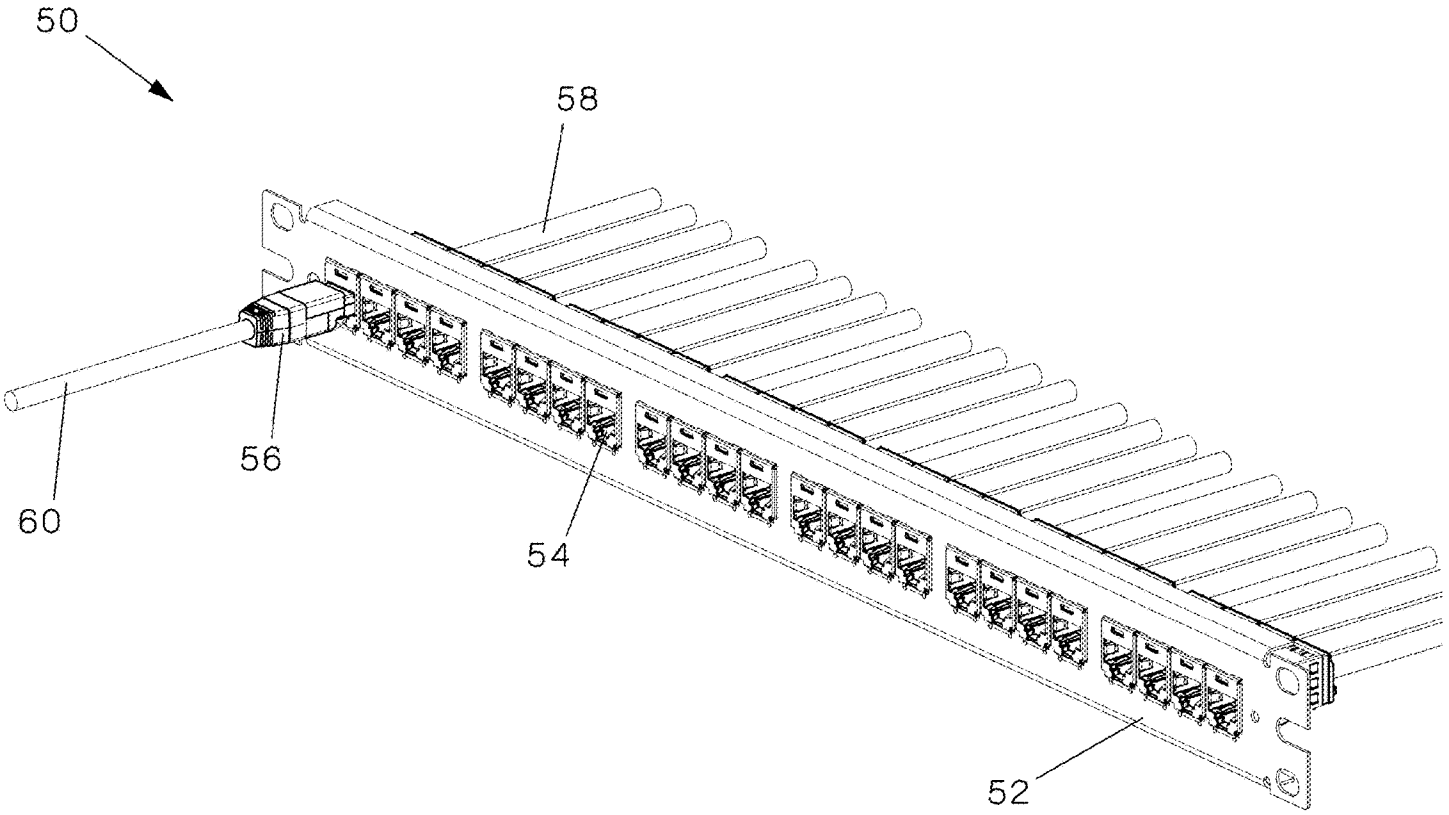
FIG. 1 is a perspective view of a communications system.

In accordance with various standards, RJ45 plugs and jacks in use today must meet certain electrical characteristics. These include the requirements for the plug to produce a predetermined amount of crosstalk and for the jack to cancel that predetermined amount of crosstalk. While the production and cancellation of crosstalk can be relatively straightforward at lower operating frequencies, as the frequencies increase, the required crosstalk cancellation (i.e., compensation) becomes more difficult. This difficulty generally stems from the physical distance between the point where crosstalk is generated and the point where crosstalk is cancelled.

Various designs have been proposed to address this issue by describing techniques to minimize the delay between the capacitive compensation in the jack and the crosstalk generation in the plug. In these cases, inductive compensation must be implemented in the jack to ensure compliance with the far-end crosstalk (FEXT) requirements of a mated connector. While the inductive compensation is required to ensure mated FEXT compliance, it also contributes to the mated near-end crosstalk (NEXT) performance. The distance between the crosstalk generation in the plug and the inductive compensation in the jack is detrimental to the mated NEXT performance as the frequency of operation is increased.

The present disclosure describes various communications systems that allow for multiple contacts points between the plug contacts in the plug and the PICs in the jack, and that allow for mating with these multiple contact points within plug contacts surface for both conventional plugs and a non-conventional plug. In some disclosed implementations, a communications system may include an RJ45 jack with at least some transmission paths having two separate plug interface contacts that allow for multiple contact points between the plug contacts in the plug and the PICs in the jack, which allows for mating with these multiple contacts points within plug contacts surface for both conventional plugs and non-conventional plugs. The communications system may also include a non-conventional plug in which at least some transmission paths having two separate plug contacts allowing for mating to the multiple plug interface contacts within the jack. Splitting the plug contacts into two separate entities compared to a standard/conventional RJ45 plug allows for a controlled delay between the two potential interface contacts between the plug and jack. The communications system may also include multiple signal paths through the plug jack mating region, which allows for more optimal positioning of capacitive and inductive compensation within the jack.

Reference will now be made to the accompanying drawings. Wherever possible, the same reference numbers are used in the drawings and the following description to refer to the same or similar parts. It is to be expressly understood, however, that the drawings are for illustration and description purposes only. While several examples are described in this document, modifications, adaptations, and other implementations are possible. Accordingly, the following detailed description does not limit the disclosed examples. Instead, the proper scope of the disclosed examples may be defined by the appended claims.

FIG. 1 illustrates an example a communications system 50 which includes patch panel 52 with shielded RJ45 network jacks 54 and corresponding shielded RJ45 plug assembly 56, terminated to respective cables 58 and 60. Once shielded RJ45 plug assembly 56 mates with a shielded RJ45 network jack 54 data can flow in both directions through these connectors. Although communications system 50 is illustrated as a patch panel in FIG. 1, alternatively it can be other active or passive equipment. Examples of passive equipment can be, but are not limited to, modular patch panels, punch-down patch panels, coupler patch panels, wall jacks, etc. Examples of active equipment can be, but are not limited to, Ethernet switches, routers, servers, physical layer management systems, and power-over-Ethernet equipment as can be found in data centers and telecommunications rooms; security devices (cameras and other sensors, etc.) and door access equipment; and telephones, computers, fax machines, printers and other peripherals found in workstation areas. Communications system 50 can further include cabinets, racks, cable management and overhead routing systems, and other such equipment.

Figure 2:
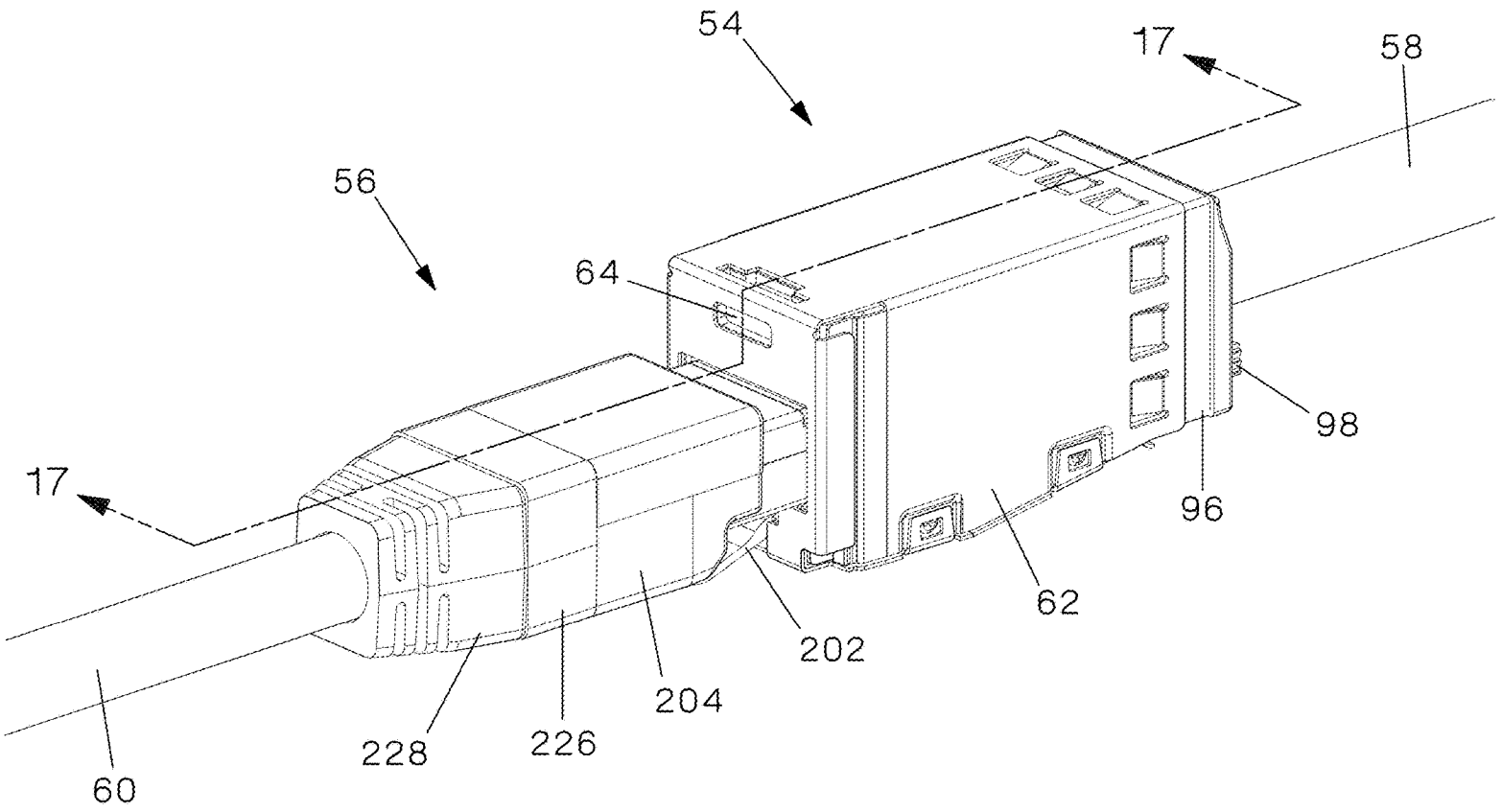
FIG. 2 is an isometric view of a shielded RJ45 network jack in a mated state with a shielded RJ45 plug assembly for use in the communications system of FIG. 1.
Figure 3:
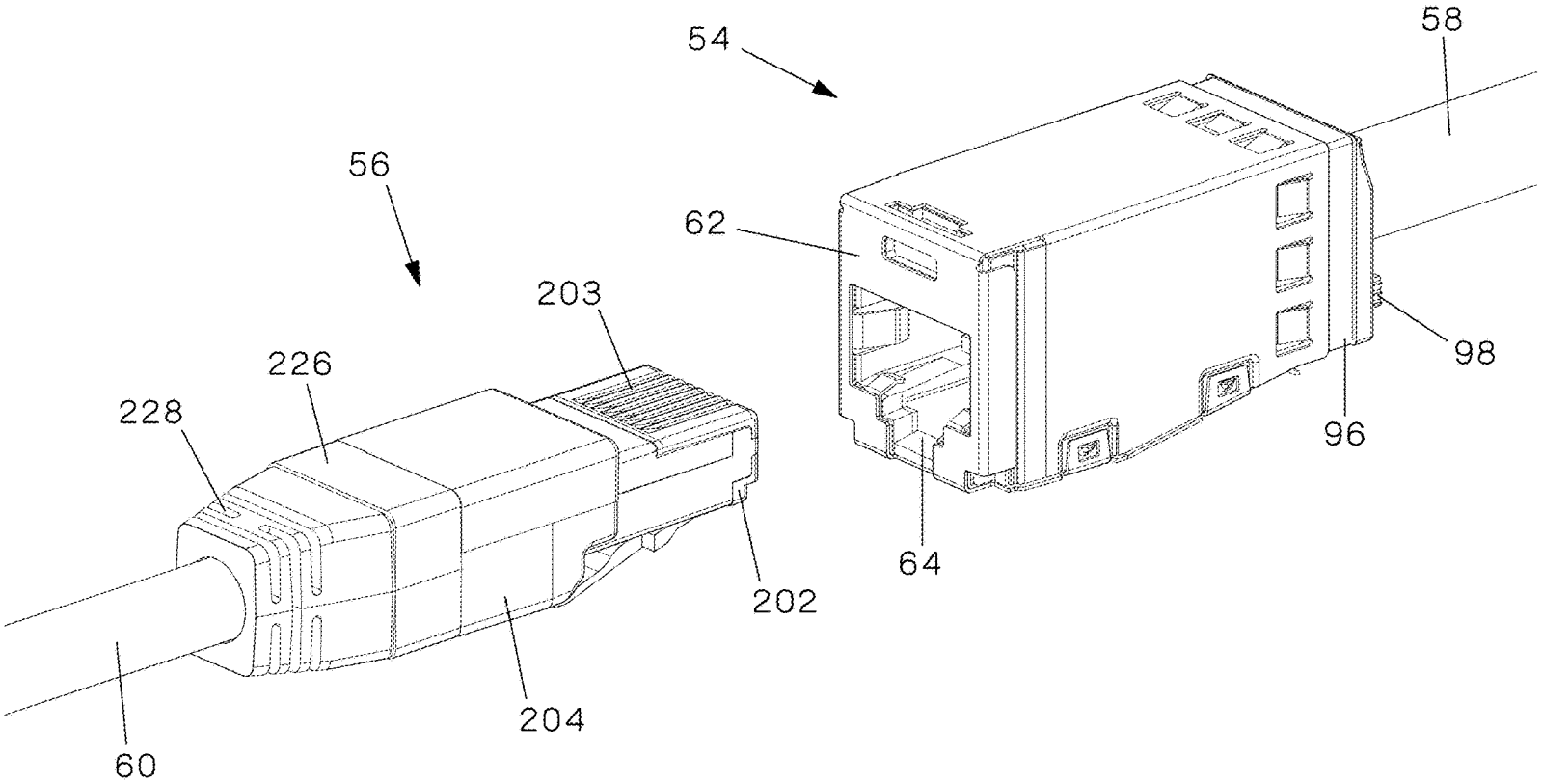
FIG. 3 is a top isometric view of the shielded RJ45 network jack exploded from the shielded RJ45 plug assembly shown in FIG. 2.
Figure 4:
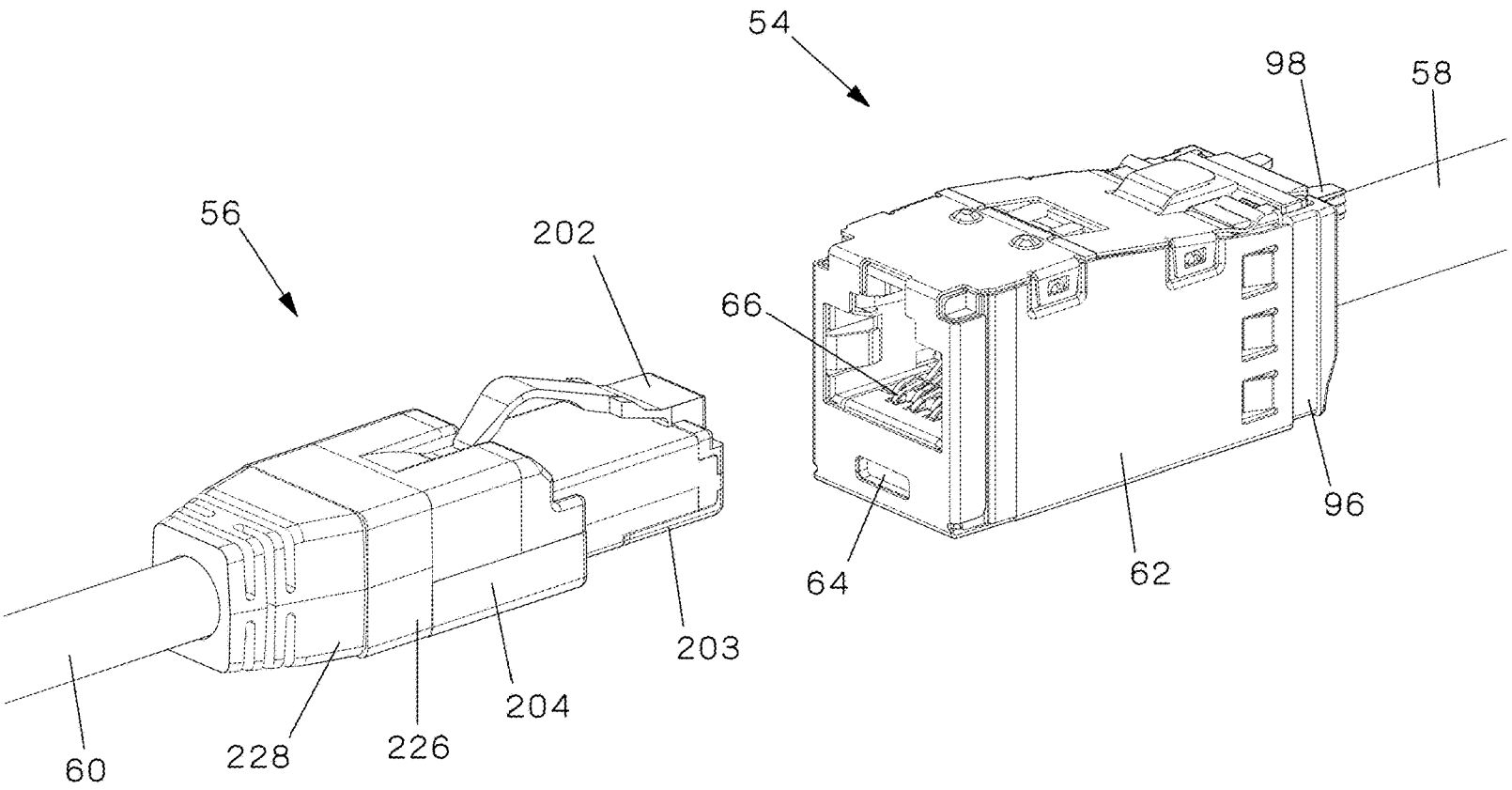
FIG. 4 is a bottom isometric view of the shielded RJ45 network jack exploded from the shielded RJ45 plug assembly shown in FIG. 2.

FIG. 2 is a top isometric view of shielded RJ45 network jack 54 mated with shielded RJ45 plug assembly 56 and respective cables 58 and 60. FIG. 3 is a top isometric view of the assembly of shielded RJ45 network jack 54 exploded from shielded RJ45 plug assembly 56. FIG. 4 is a bottom isometric view of the assembly of shielded RJ45 network jack 54 from shielded RJ45 plug assembly 56.

Figure 5:
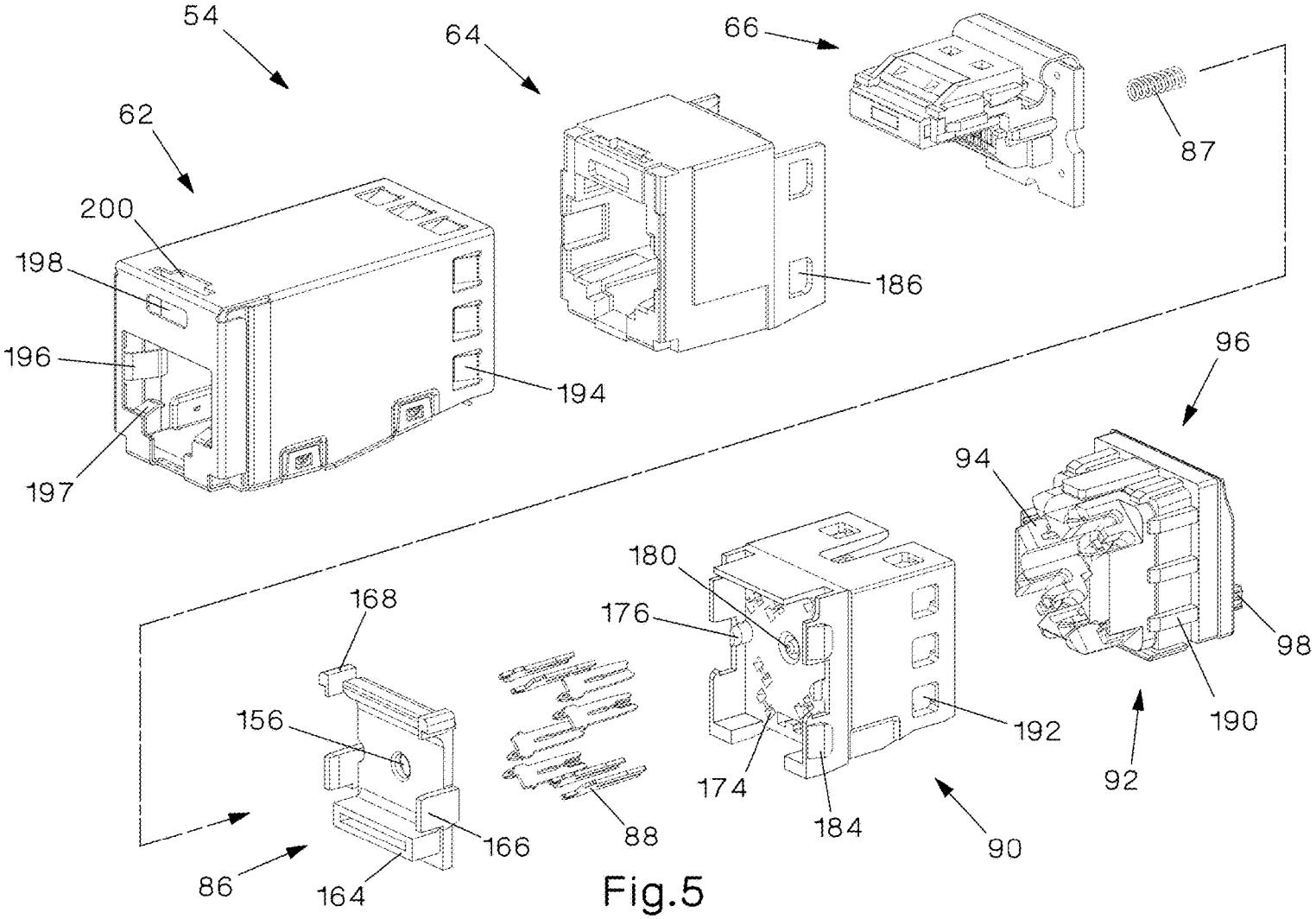
FIG. 5 is an exploded front top isometric view of the shielded RJ45 network jack shown in FIG. 2.
Figure 6:
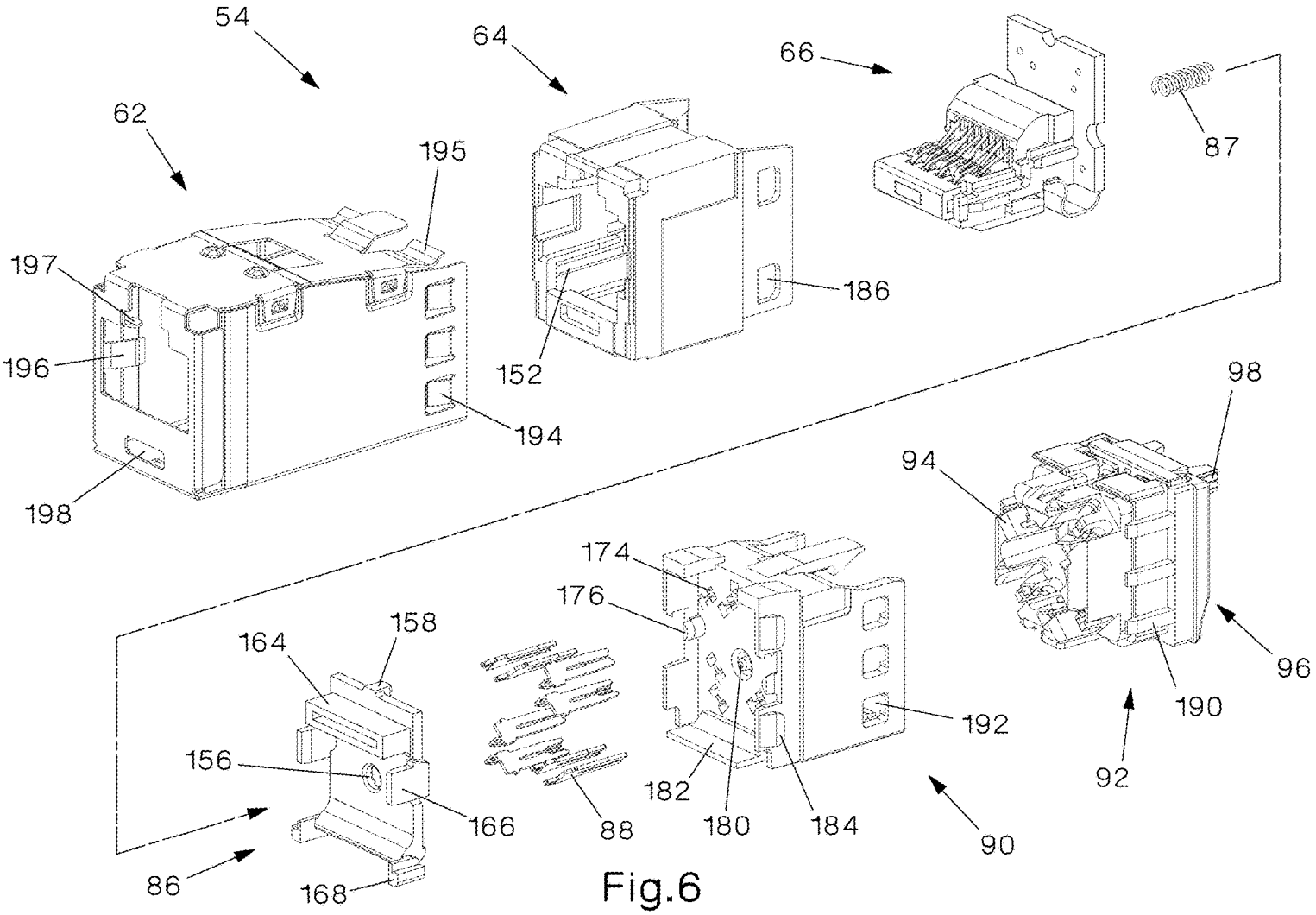
FIG. 6 is an exploded front bottom isometric view of the shielded RJ45 network jack shown in FIG. 2.
Figure 7:
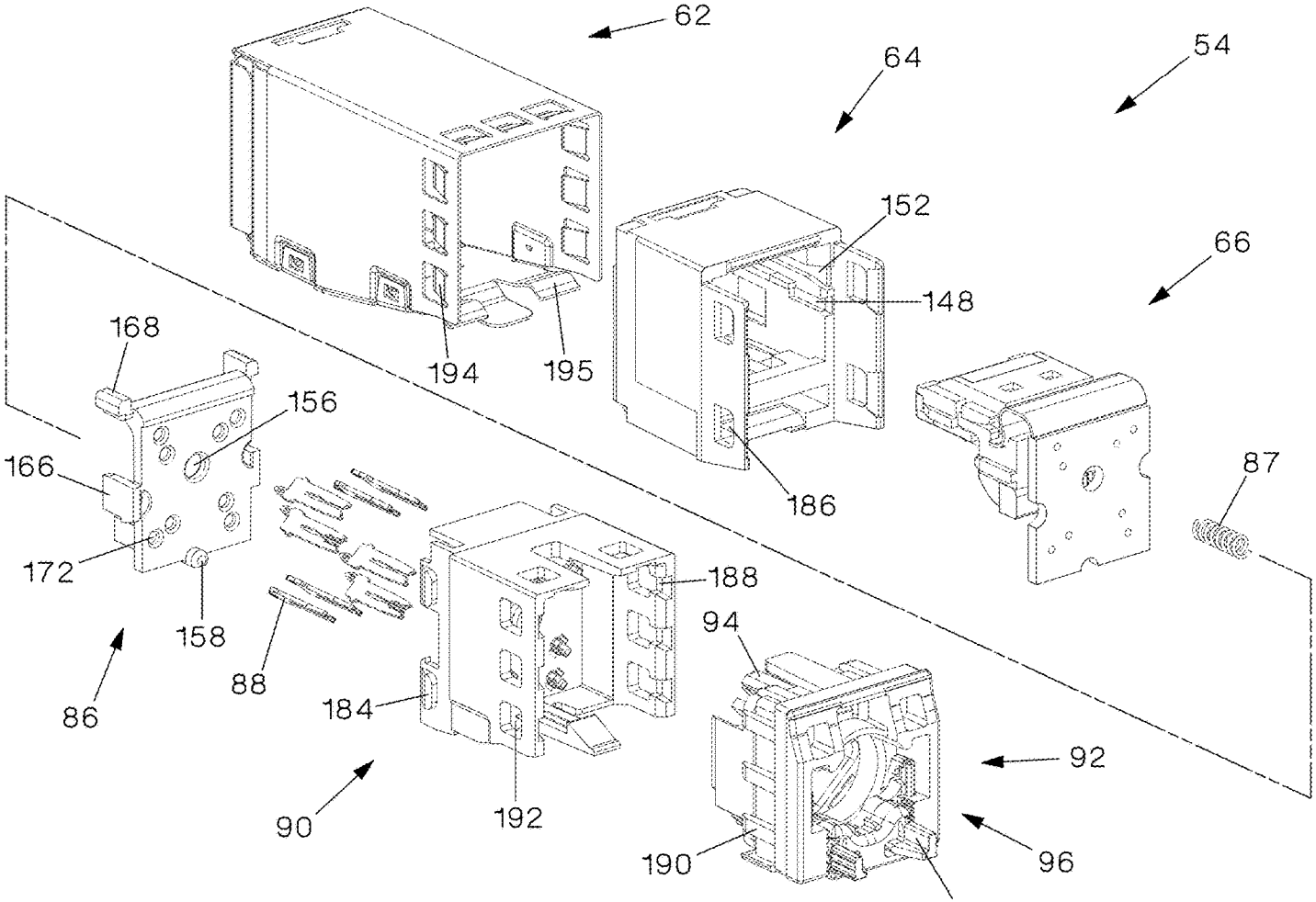
FIG. 7 is an exploded rear top isometric view of the shielded RJ45 network jack shown in FIG. 2.

FIG. 5 is an exploded front top isometric view of shielded network jack 54. Shielded RJ45 network jack 54 includes conductive shield 62, jack housing 64, sled assembly 66 (which includes front odd PICs 68, front even PICs 70, rear odd PICs 72, rear even PICs 74, front sled holder 76, middle sled holder 78, back sled holder 80, rear PIC comb 82, and rigid-flex PCB 84, shown in FIG. 8), PCB support 86, spring 87, insulation displacement contacts (IDCs) 88, rear sled 90, wire cap assembly 92 (which includes wire cap conductor holder 94, conductive wire cap back 96, and conductive strain relief clip 98). FIG. 6 is an exploded front bottom isometric view of shielded RJ45 network jack 54. FIG. 7 is a rear top isometric exploded view of shielded RJ45 network jack 54.

Figure 8:
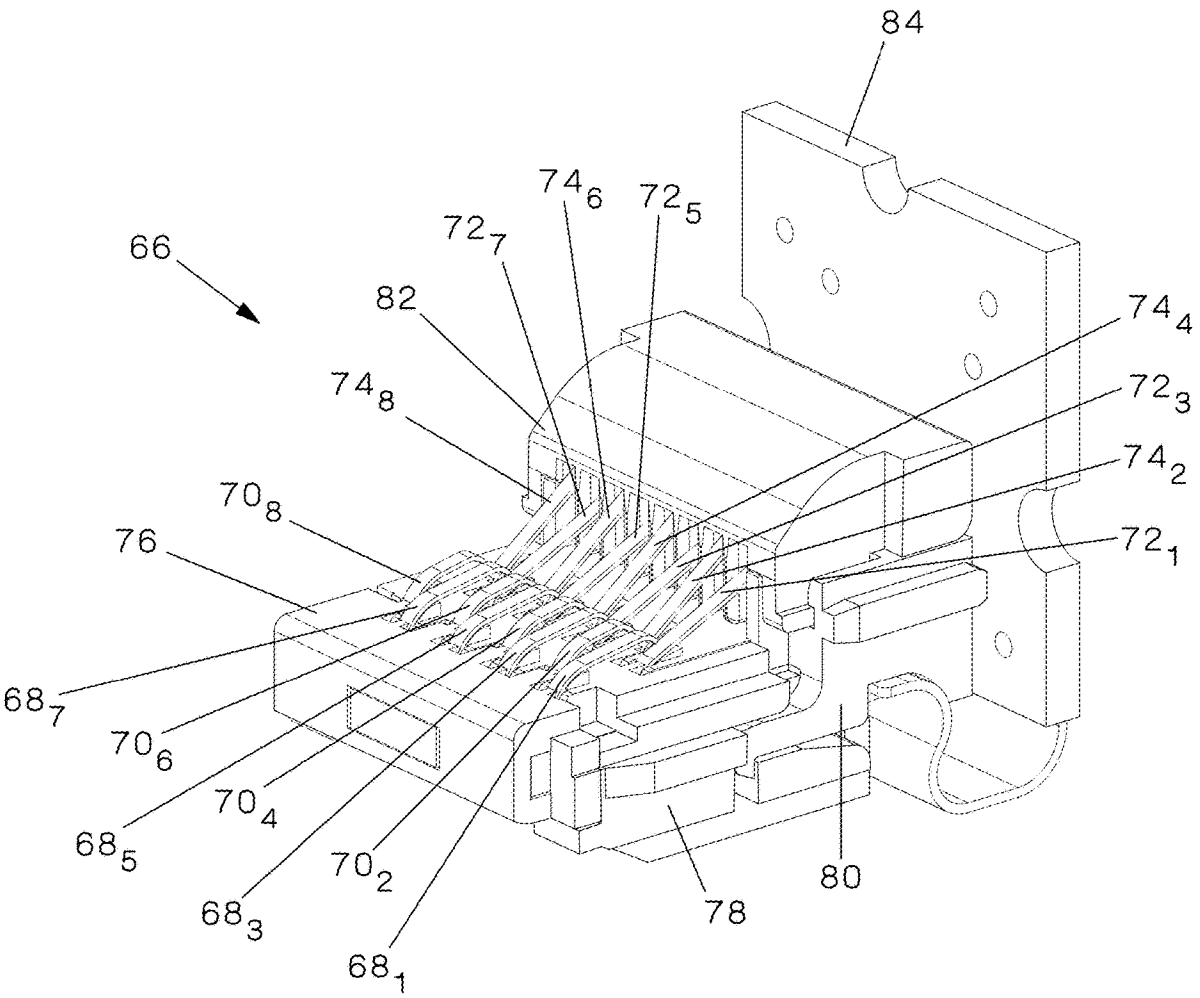
FIG. 8 is a front isometric view of a sled assembly included in the shielded RJ45 network jack shown in FIG. 2.
Figure 9:
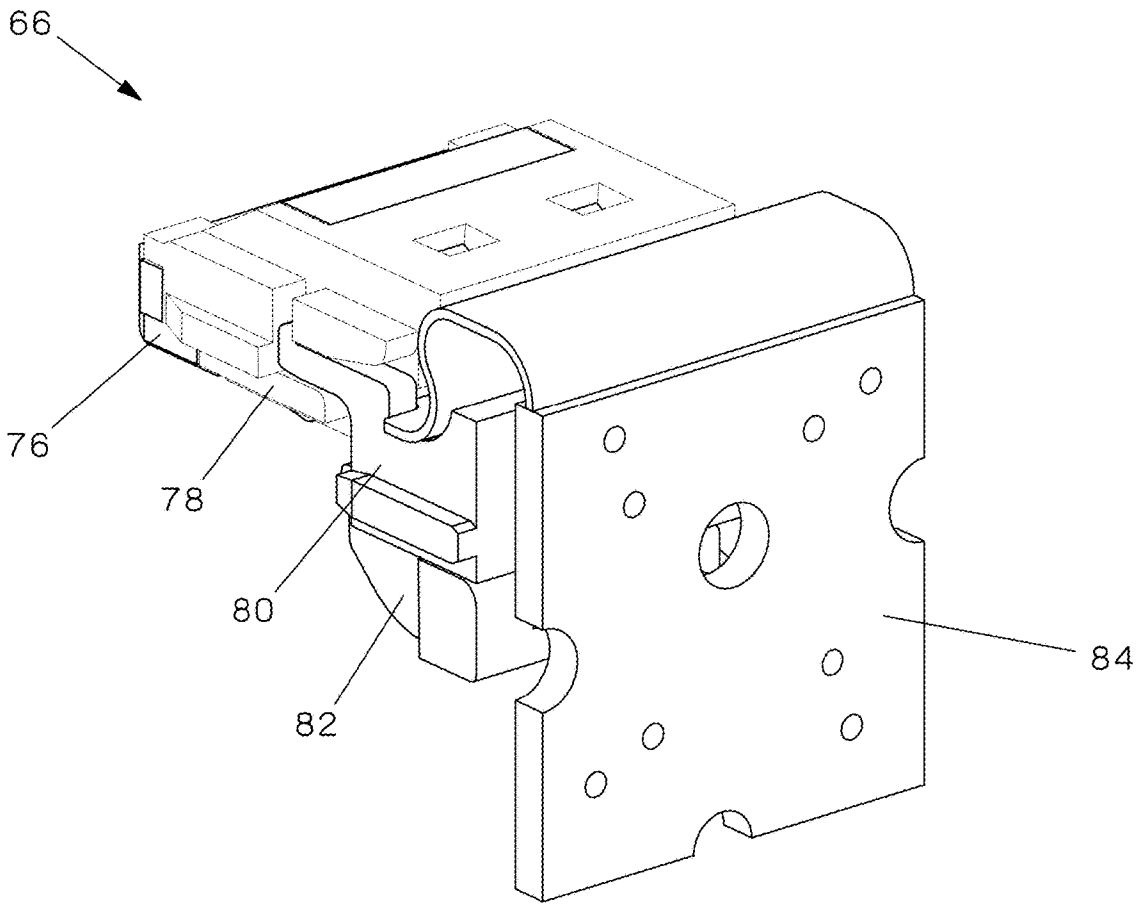
FIG. 9 is a rear isometric view of the sled assembly shown in FIG. 8.
Figure 10:
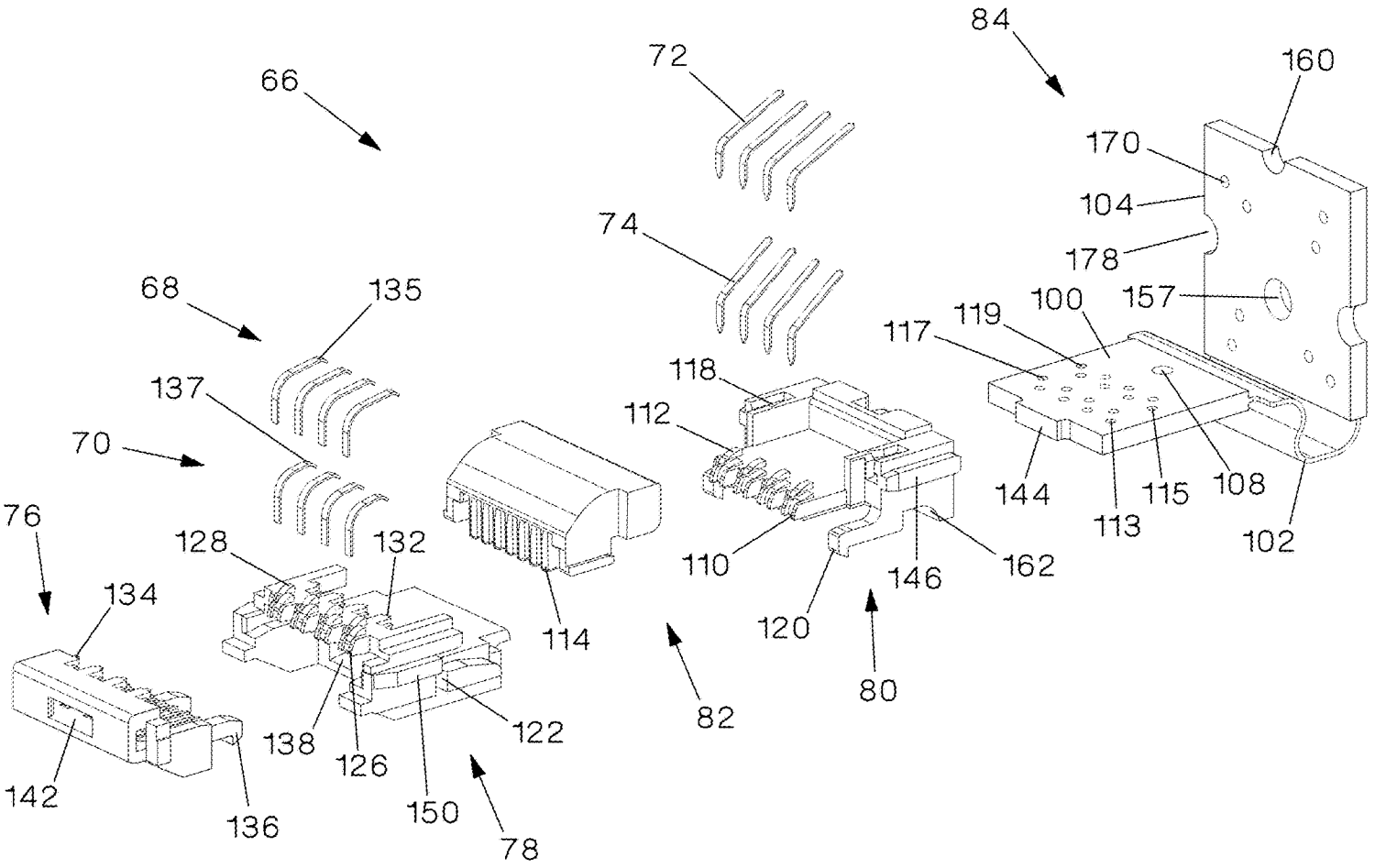
FIG. 10 is an exploded front isometric view of the sled assembly shown in FIG. 8.
Figure 11:
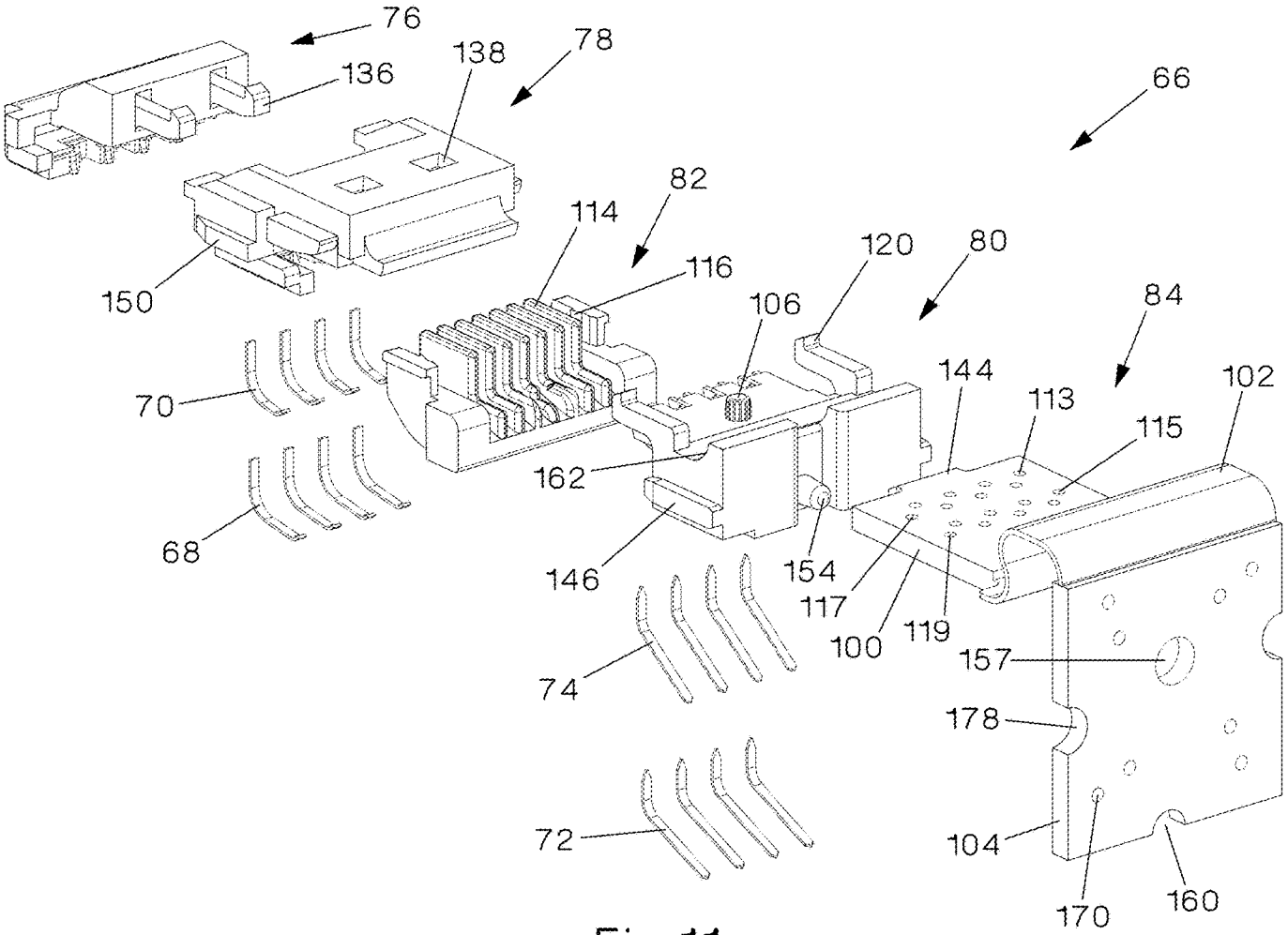
FIG. 11 is an exploded rear isometric view of the sled assembly shown in FIG. 8.

FIG. 8 is a front isometric view in the same orientation as that of FIG. 6 of sled assembly 66. FIG. 9 is a rear isometric view in the same orientation as that of FIG. 7 of sled assembly 66. FIG. 10 is an exploded front isometric view in the same orientation as that of FIG. 8 of sled assembly 66. FIG. 11 is an exploded rear isometric view in the same orientation as that of FIG. 9 of sled assembly 66. Rigid-flex PCB 84 is divided into three sections, front rigid section 100, middle flex section 102, and rear rigid section 104.

During assembly of sled assembly 66, the first task is to secure the back sled holder 80 to rigid-flex PCB 84. Back sled holder 80 includes an alignment post 106, which aligns with an alignment hole 108 on front rigid section 100. Comb ribs 110 on back sled holder 80 act to keep rear odd PICs 72 and rear even PICs 74 in respective slots. PIC mandrels 112 on back sled holder 80 act to control the bend radius of rear odd PICs 72 and rear even PICs 74. Unlike typical mandrels for controlling bend radius control of PICs, PIC mandrels 112 extend within the RJ45 plug combs during the assembled state. Rear odd PICs 72 are secured to front rigid section 100 at a row of vias 115 and rear even PICs 74 are secured to front rigid section 100 at a row of vias 119 through the means of a soldered connection but other non-limiting means including a press fit connection may be used. Then to keep respective rear odd PICs 72 and rear even PICs 74 aligned rear PIC comb 82 is attached to back sled holder 80, which has alignment combs 114. This connection is made via snaps 116 on PIC comb 82 which align with pockets 118 on back sled holder 80.

The next step is to slide middle sled holder 78 over front rigid section 100 and connect middle sled holder 78 to back sled holder 80. Back sled holder 80 has latches 120 which align with receptive latch pockets 122 of middle sled holder 78. Comb ribs 126 on middle sled holder 78 act to keep front odd PICs 68 and front even PICs 70 in respective slots. PIC mandrels 128 on middle sled holder 78 act to control the bend radius of front odd PICs 68 and front even PICs 70. Unlike typical mandrels for controlling bend radius control of PICS, PIC mandrels 128 extends within the RJ45 plug combs during the assembled state. Front odd PICs 68 are secured to front rigid section 100 at vias 113 and front even PICs 70 are secured to front rigid section 100 at vias 117 through the means of a soldered connection but other non-limiting means including a press fit connection may be used. Rows of vias 113, 115, 117, and 119 may all be different rows on front rigid section 100.

Both middle sled holder 78 and rear sled holder 80 have respective flex support mandrels 132 and 134 that control the bend radius of middle flex section 102 as it transitions from front rigid section 100. Both front odd PICs 68 and front even PICs 70 have a respective secondary bend 135 and 137 that helps reduce the chance of front odd PICS 68 and front even PICs 70 snagging when the plug is withdrawn.

The next step is to slide front sled holder 76 over front rigid section 100 and connect front sled holder 76 to middle sled holder 78. Front sled holder 76 has latches 136 which align with receptive latch pockets 138 of middle sled holder 78. Front sled holder 76 has PCB pocket 142, which aligns with PCB notch 144 on front rigid section 100, which serves dual purposes of providing more PCB routing space and added alignment.

Rear sled holder 80 includes guide rails 146 which align with respective guide slots 148 of jack housing 64. Middle sled holder 78 includes guide rails 150 which align with respective guide slots 152 of jack housing 64.

Rear sled holder 80 includes spring post 154 for alignment of spring 87 during final assembly. PCB support 86 includes spring hole 156, which provides clearance for spring 87. Rear rigid section 104 also include a PCB spring hole 157 for clearance of spring 87. PCB support 86 includes a placement post 158 which aligns with placement hole 160 of rear rigid section 104. Bend radius control mandrel 162 of rear sled holder 80, controls the bend radius of middle flex section 102 as it transitions into rear rigid section 104. In order to back up PCB support 86 during termination of cable 58 to IDCs 88, multiple support features have been added. These support features include top support bar 164, middle support arms 166, and bottom support arms 168.

IDCs 88 are terminated to vias 170 of rear rigid section 104 though a compliant pin termination but other non-limiting means of termination may be used such as soldering. Clearance holes 172 on PCB support 86 act as clearance for IDCs 88. Clearance slits 174 of rear sled 90 act as clearance for IDCs 88. Positioning posts 176 of rear sled 90 align with positioning cutouts 178 of rear rigid section 104. Rear sled 90 includes spring post 180 for alignment of spring 87 during final assembly. Rear sled 90 includes flex spacer 182, which controls the spacing between middle flex section 102 and conductive shield 62. This controlled spacing is preferred for better impedance control within the middle flex section 102, as if there was inconsistent spacing between middle flex section 102 and conductive shield 62, electrical results would be more unpredictable. Rear sled 90 includes housing snaps 184 which align with snap pockets 186 of jack housing 64.

Rear sled 90 includes alignment slots 188, which align with grounding ribs 190 of conductive wire cap back 96. Alignment slots 188 help to ensure that when inserting wire cap assembly 92 into rear sled 90, proper alignment occurs before IDCs 88 engage with the conductors of cable 58. Grounding pockets 192 of rear sled 90 provide clearance for grounding flanges 194 of conductive shield 62, which during final assembly make an electromechanical connection with grounding ribs 190. Grounding flanges 195 of conductive shield 62 also makes an electromechanical connection with conductive wire cap back 96 but is not constrained by rear sled 90. Plug grounding flanges 196 and 197 make contact with the shield/conductive body of respective shielded RJ45 plug assemblies and provide an electrical bond. Reliably bonding all of the metal non-signal carrying components mitigates EMI susceptibility and enables shielding effectiveness that will meet the standards' requirements.

In conventional RJ45 shielded solutions there are only two contact regions between the external shield of the plug and that of the jack, as this is all that is defined in IEC 60603-7-1:2011 and IEC 60603-7-7:2010. This contact region is on the side of the plug and jack comparable to the contact of plug grounding flanges 196. However, as the operating frequency of the jack increases, complying with the shielding effectiveness requirements becomes more challenging. This is due to the fact that as the frequency of the signal increases, the impedance through any one shielding interface increases due to the inductance through the shielding contact. To ensure a low impedance shield connection through the connectivity, multiple contact locations between the plug and jack shield can be added to lower the overall inductance. In addition, higher frequency signals will pass through smaller and smaller openings, which in turn has a negative effect on the EMC performance of a cabling system. The addition of plug grounding flanges 197 creates a more comprehensive grounding connection around the port opening. In order to further reduce the opening size of conductive shield 62, shield icon slot 198 and shield front latching slot 200 were both reduced so that the outer interface is covered by conductive shield 62.

IDCs 88 of shielded RJ45 network jack 54 are arranged in a balanced manner to maintain acceptably low levels of internal pair-to-pair coupling. Additionally, IDCs 88 are spaced within each pair to maintain a predetermined impedance so as to not detrimentally affect return loss at the wire cap termination interface.

Figure 12:
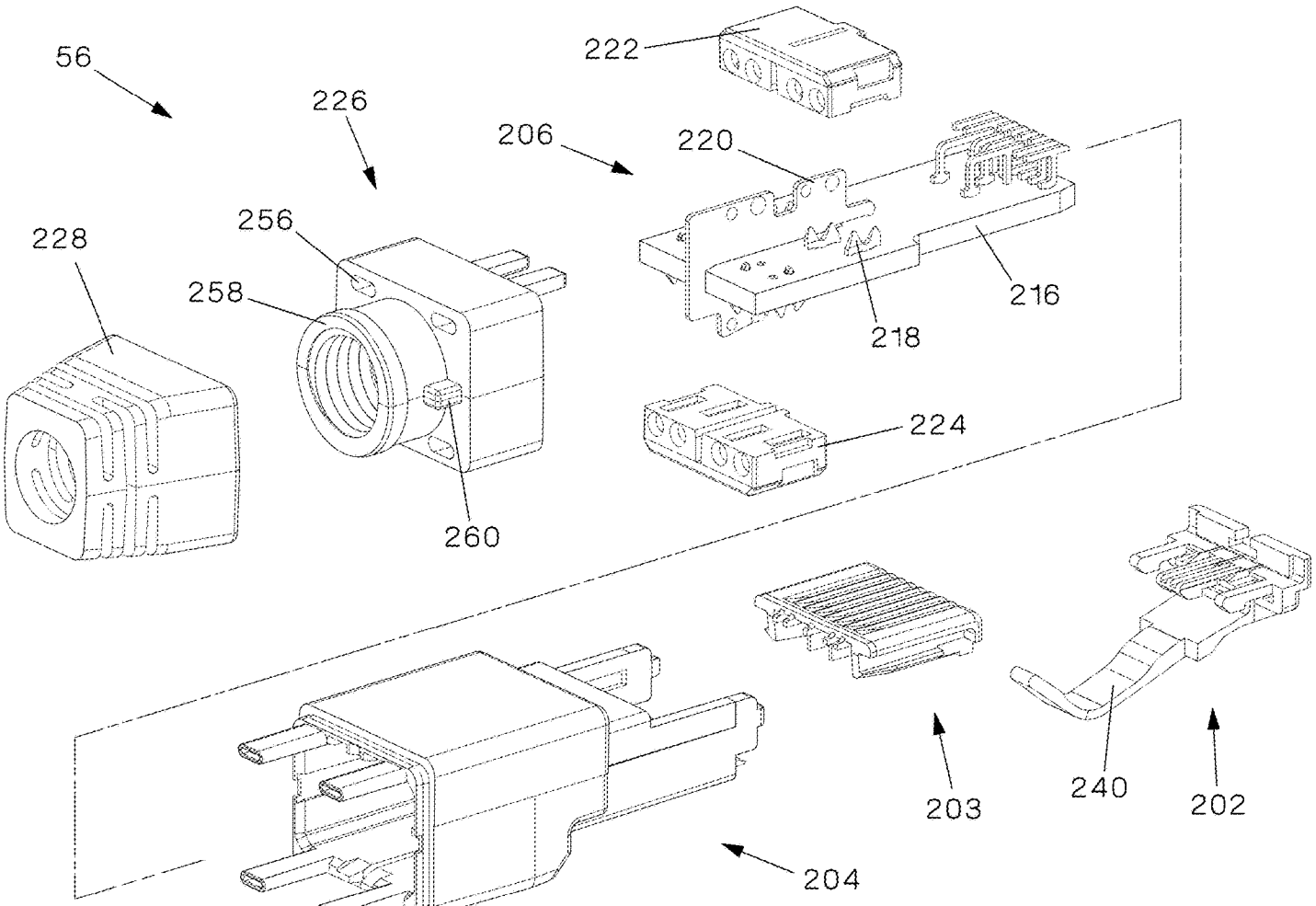
FIG. 12 is an exploded rear top isometric view of the shielded RJ45 plug assembly shown in FIG. 2.
Figure 13:
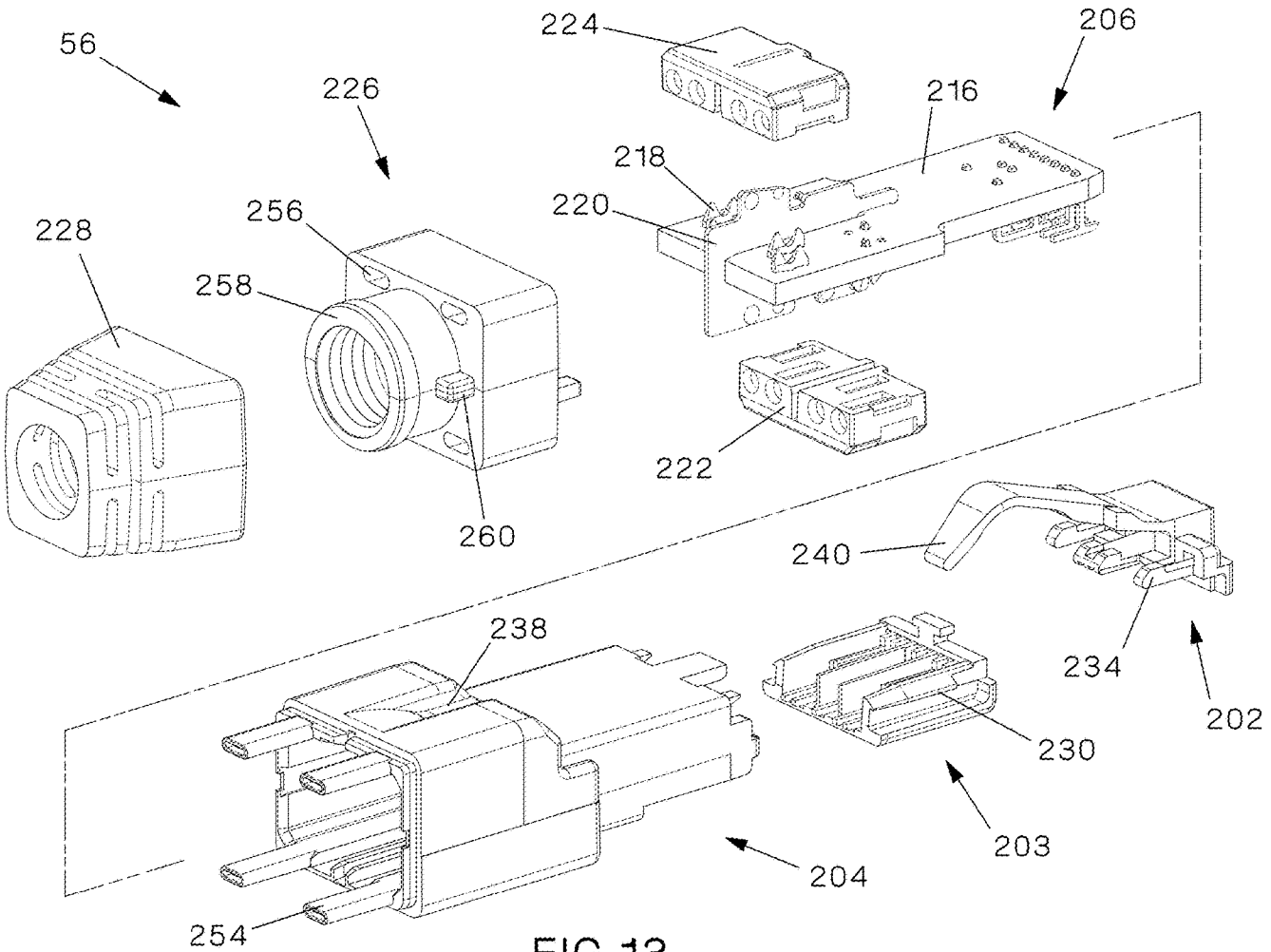
FIG. 13 is an exploded rear bottom isometric view of the shielded RJ45 plug assembly shown in FIG. 2.
Figure 14:
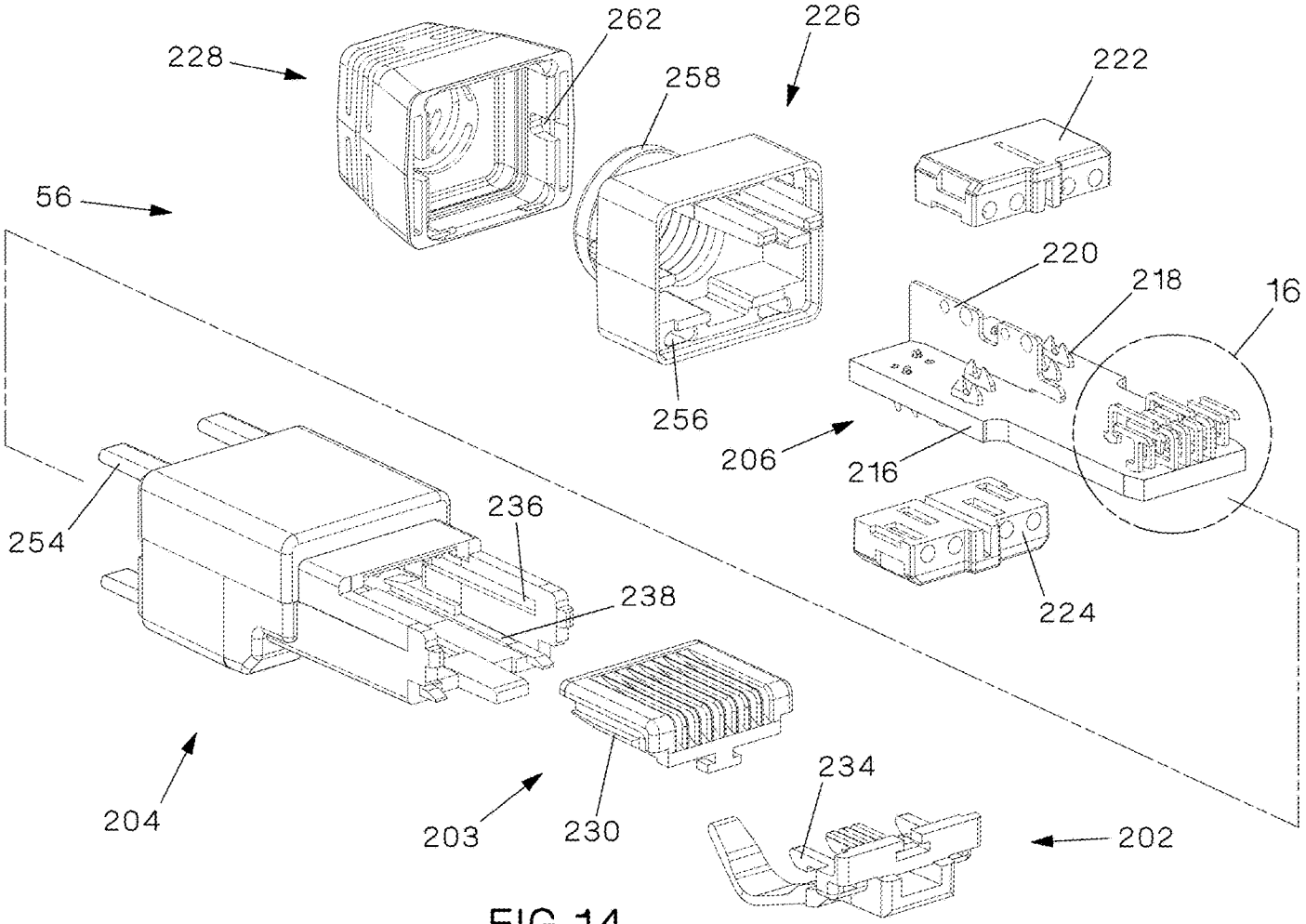
FIG. 14 is an exploded front top isometric view of the shielded RJ45 plug assembly shown in FIG. 2.
Figure 15:
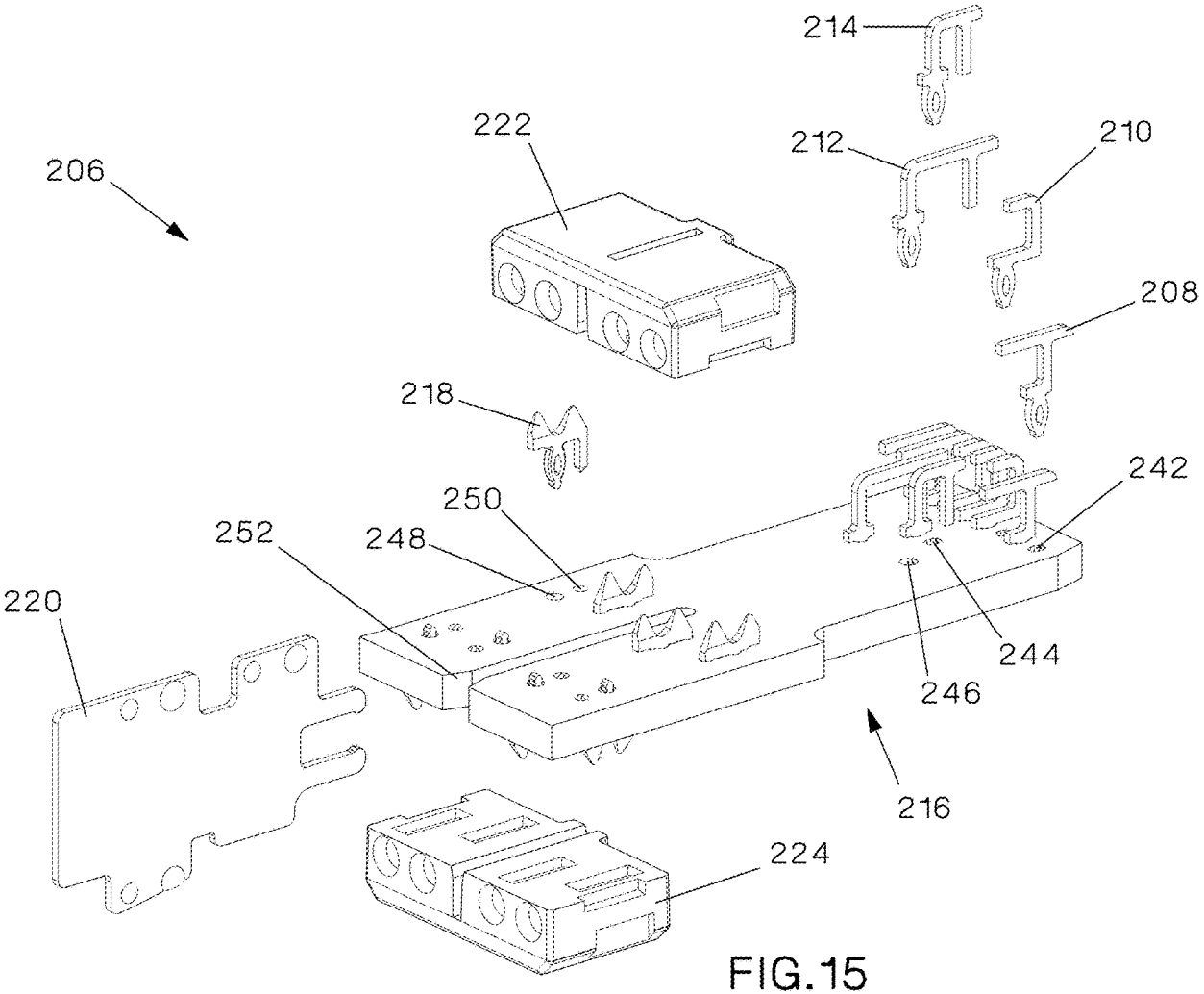
FIG. 15 is an exploded rear top isometric view of a printed circuit board (PCB) assembly included in the shielded RJ45 plug assembly shown in FIG. 2.

FIG. 12 is an exploded rear top isometric view of shielded RJ45 plug assembly 56. Shielded RJ45 plug assembly 56 includes front housing 202, front combs 203, conductive shell 204, PCB assembly 206 (which includes plug contacts 208, plug contacts 210, plug contacts 212, plug contacts 214, PCB 216, insulation piercing contacts (IPCs) 218, shielded divider 220, front load bar 222, and rear load bar 224), rear conductive shell 226, and bend radius control boot 228. FIG. 13 is an exploded rear bottom isometric view of shielded RJ45 plug assembly 56. FIG. 14 is a front top isometric exploded view of shielded RJ45 plug assembly 56. FIG. 15 is an exploded rear top isometric view of PCB assembly 206.

During the assembly operation of shielded RJ45 plug assembly 56 the first step places rear conductive shell 226 and bend radius control boot 228 over shielded cable 60. During the assembly process front combs 203 attaches to conductive shell 204 through latches 230, which aligns with pockets 236. During the assembly process front housing 202 attaches to conductive shell 204 through latches 234, which aligns with pockets 238.

Once PCB assembly 206 is installed, latches 234 are trapped from backing out of pocket 238. Relief slot 238 in conductive shell 204 acts as both clearance and an added tangle prevention feature for plug latch 240.

During the assembly process of PCB assembly 206, plug contacts 208-214 are placed into vias 242, 244, and 246.

Vias 242, 244, and 246 are positioned in different rows on PCB 216. Plug contacts 208 and 210 attach to PCB 216 in a first row of vias 242, plug contacts 214 attach to PCB 216 in a second row of vias 244, and plug contacts 214 attach to PCB 216 in a third row of vias 246. Plug contacts 208 may be generally T-shaped, plug contacts 210 may be generally C-shaped, and plug contacts 212 and 214 may be generally upside-down U-shaped.

Plug contacts 208-214 are shown with compliant pin connections but other non-limiting means such as soldering may be used for electrical and mechanical interfacing with PCB 216. Unlike many vias in electrical connectors, vias 242-246 are routed such that at least some are not circular, instead they are oval. This is to increase the spacing between adjacent vias, while still allowing for a reliable compliant pin design. IPCs 218 are placed into IPC vias 248 and un-plated holes 250. Shielded divider 220 slides into PCB slot 252; shielded divider 220 is secured in the assembly when front load bar 222 and rear load bar 224 are installed.

Electrical isolation of IPCs 218 is achieved through three means. The first mean is from foil over the pairs in cable 60. This foil isolates coupling from the front row of conductors to the bottom, through PCB 216 as conductor pairs are no longer in foil when in rear load bar 224. The second means is through isolation with shielded divider 220, which mitigates coupling of adjacent pairs, specifically when no longer in foil. The third means of isolation is front to back separation of the front load bar 222 and rear load bar 224 such that no conductor pair that is not in foil runs on top of each other over PCB 216. In order to insulate the foil from IPCs 218 and PCB 216, a polyimide film may be placed over the board or the exposed areas of foil may be covered with a non-conductive material such as, but not limited to, heat shrink or tape.

The alignment of rear conductive shell 226 and conductive shell 204 is ensured by the alignment of posts 254 of conductive shell 204 and alignment slots 256 of rear conductive shell 226. The length of alignment posts 254 helps strengthen and secure the crimp tooling. Engagement rib 258 on rear conductive shell 226 acts to secure bend radius control boot 228. Embosses 260 of rear conductive shell 226 align clearance slots 262 which prevent rotation of bend radius control boot 228 during final assembly.

Figure 16:
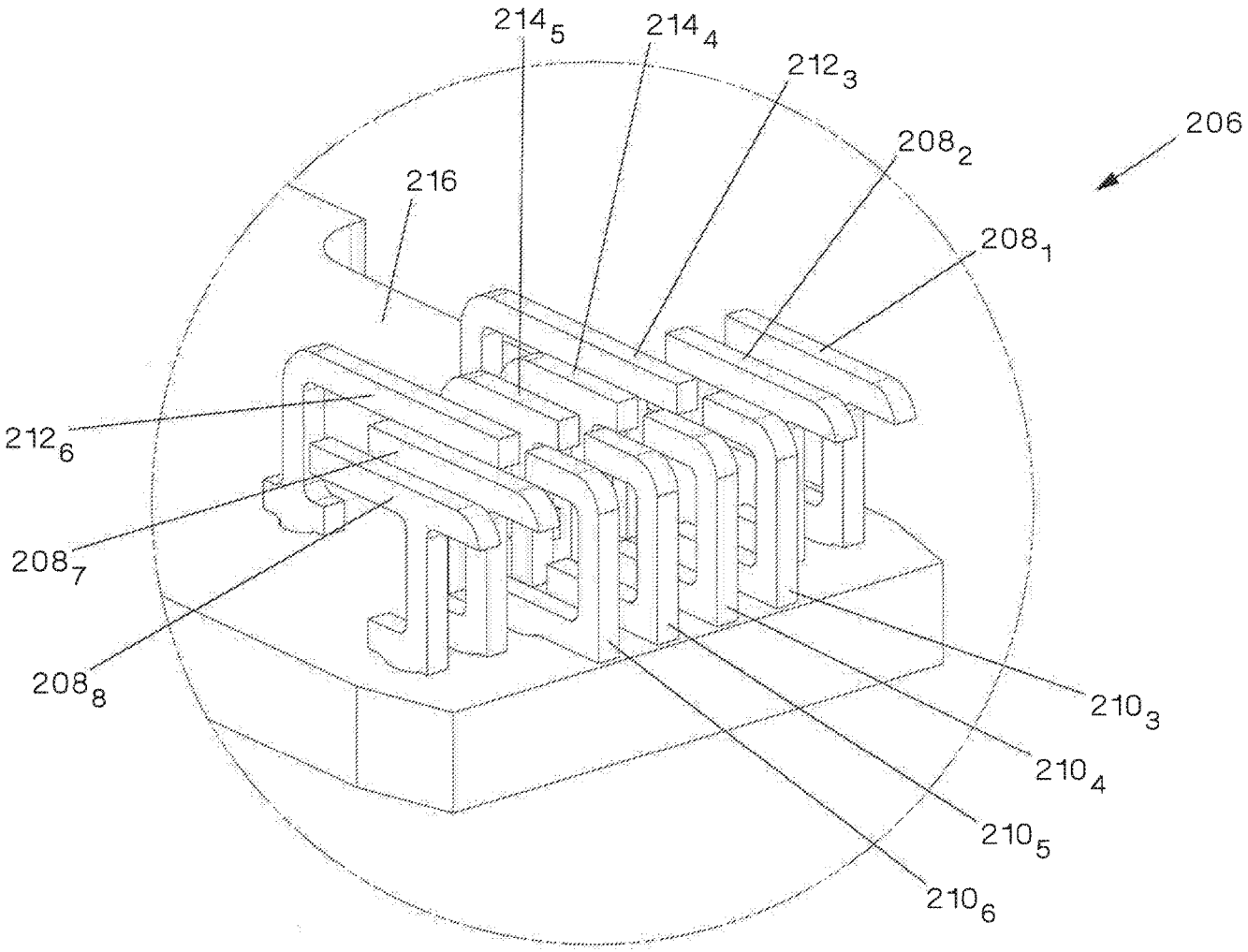
FIG. 16 is a detailed view of a plug contact region of the PCB assembly shown in FIG. 15.

FIG. 16 is a detailed view of the plug contact region 16 taken from FIG. 14. Plug contacts 208 are associated with conductor 1, 2, 7, and 8 where the conductor numbers correspond with EIA/TIA 568B numbering sequence. The conductors within an RJ45 plug are typically labelled 1-8, in sequential order. The wiring of these cables to RJ45 connectors to make a straight through cable is defined by EIA/TIA 568B. When mated with shielded RJ45 network jack 54 plug contact $\mathbf{208}_1$ mates with both front odd PIC $\mathbf{68}_1$ and rear odd PIC $\mathbf{72}_1$ where the coefficients correspond with respective the EIA/TIA 568B numbering sequence. When mated with shielded RJ45 network jack 54 plug contact $\mathbf{208}_2$ mates with both front even PIC $\mathbf{70}_2$ and rear even PIC $\mathbf{74}_2$. When mated with shielded RJ45 network jack 54 plug contact $\mathbf{208}_7$ mates with both front odd PIC $\mathbf{68}_7$ and rear odd PIC $\mathbf{72}_7$. When mated with shielded RJ45 network jack 54 plug contact $\mathbf{208}_8$ mates with both front even PIC $\mathbf{70}_8$ and rear even PIC $\mathbf{74}_8$.

Plug contacts 210 are associated with conductor 3, 4, 5, and 6, however instead of mating with multiple PICs, each plug contact 210 only mates with one PIC. When mated with shielded RJ45 network jack 54 plug contact $\mathbf{210}_3$ mates with rear odd PIC $\mathbf{72}_3$. When mated with shielded RJ45 network jack 54 plug contact $\mathbf{210}_4$ mates with rear even PIC $\mathbf{74}_4$. When mated with shielded RJ45 network jack 54 plug contact $\mathbf{210}_5$ mates with rear odd PIC $\mathbf{72}_5$. When mated with shielded RJ45 network jack 54 plug contact $\mathbf{210}_6$ mates with rear even PIC $\mathbf{74}_6$.

Plug contacts 212 are associated with conductors 3 and 6, and also only mate with one PIC. When mated with shielded RJ45 network jack 54 plug contact $\mathbf{212}_3$ mates with front odd PIC $\mathbf{68}_3$. When mated with shielded RJ45 network jack 54 plug contact $\mathbf{212}_6$ mates with front even PIC $\mathbf{70}_6$. Plug contacts 214 are associated with conductors 4 and 5, and also only mate with one PIC. When mated with shielded RJ45 network jack 54 plug contact $\mathbf{214}_4$ mates with front even PIC $\mathbf{70}_4$. When mated with shielded RJ45 network jack 54 plug contact $\mathbf{214}_5$ mates with front odd PIC $\mathbf{68}_5$.

The IEC-60603-7:2010 preferred electrical mating point location is typically considered roughly on the front radius of the plug contact. When shielded RJ45 plug assembly 56 is mated with shielded RJ45 network jack 54 both rear odd PICs 72 and rear even PICs 74 mate in what would be defined as the IEC-60603-7:2010 preferred electrical mating point location. When shielded RJ45 plug assembly 56 is mated with shielded RJ45 network jack 54 both front odd PICs 68 and front even PICs 70 mate on the flat of a plug surface which is out of the defined IEC-60603-7:2010 preferred electrical mating point location, but still can be used for mating.

To prevent snagging of either front odd PICs 68 or front even PICs 70 upon retraction of shielded RJ45 plug assembly 56 from shielded RJ45 network jack 54, the plug contact mating surface needs either be roughly flat or slope up into the plug combs so that upon withdrawing shielded RJ45 plug assembly 56 there is no catch point. Also, the plug contact mating surface needs to be relatively continuous. As on at least some of the conductors there are multiple plug contacts, this surface is no longer continuous. Leveling rib 263 of front combs 203 acts as a surface to keep the gap between two plug contacts relatively continuous, specifically this is done between plug contacts 210 and plug contacts 212 as well as between plug contacts 210 and plug contacts 214. Upon withdrawal of shielded RJ45 plug assembly 56 from shielded RJ45 network jack 54, front odd PICs 68 or front even PICs 70 would temporarily make contact with leveling ribs 263 of front combs 203.

Figure 17:
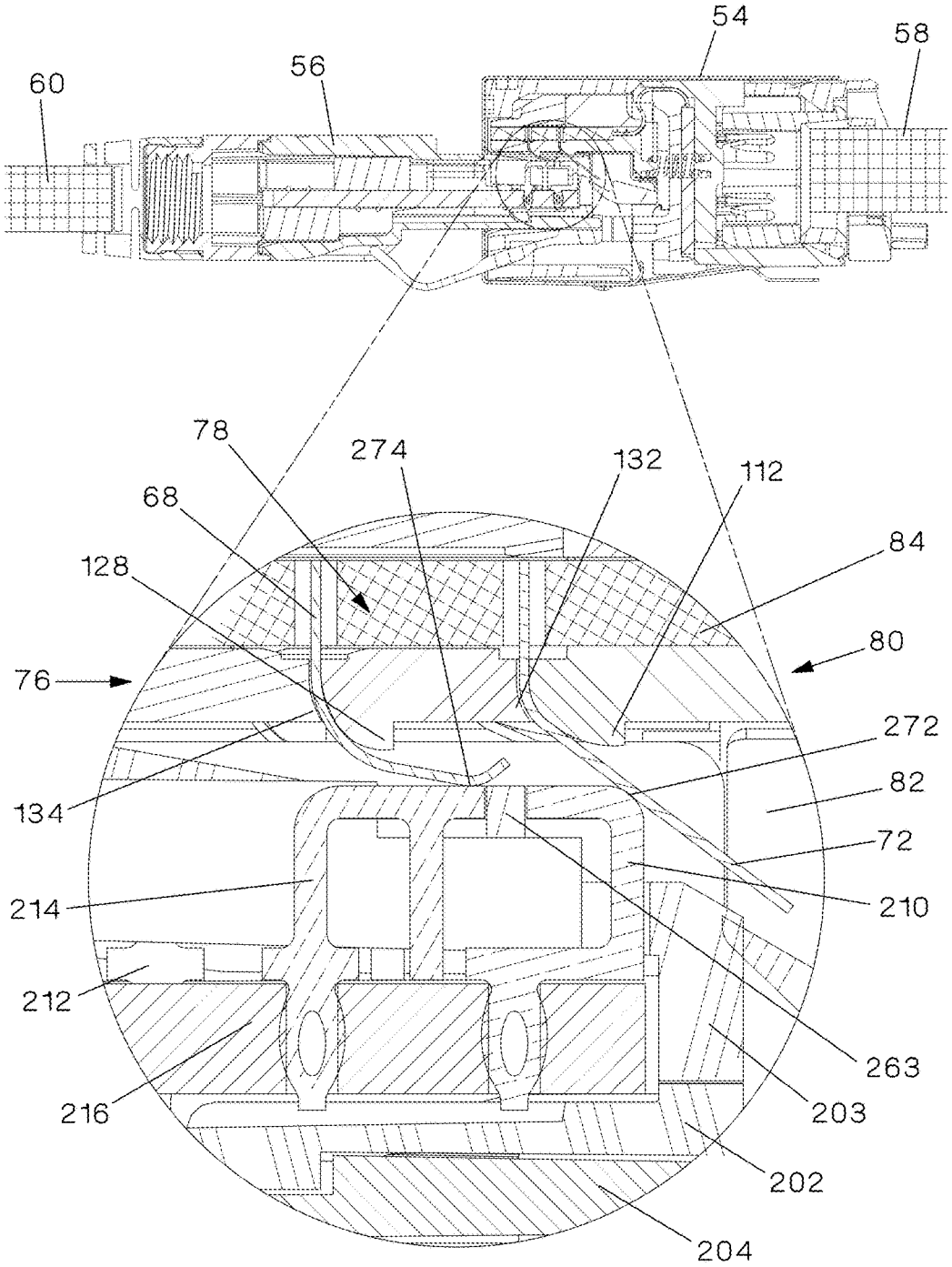
FIG. 17 is a cross-sectional view about section line 17-17 of FIG. 2.

FIG. 17 is a cross-section taken from FIG. 2 about section line 17-17 of the mated assembly of shielded RJ45 network jack 54 and shielded RJ45 plug assembly 56, and respective cables 58 and 60. There are two distinct planes of mating interface. Leading contact points 272 occur between rear odd PICs 72 and rear even PICs 74 and respective plug contacts 208 and plug contacts 210. Trailing contact points 274 occur between front odd PICs 68 and front even PICs 70 and respective plug contacts 208, plug contacts 212, and plug contacts 214.

Figure 18:
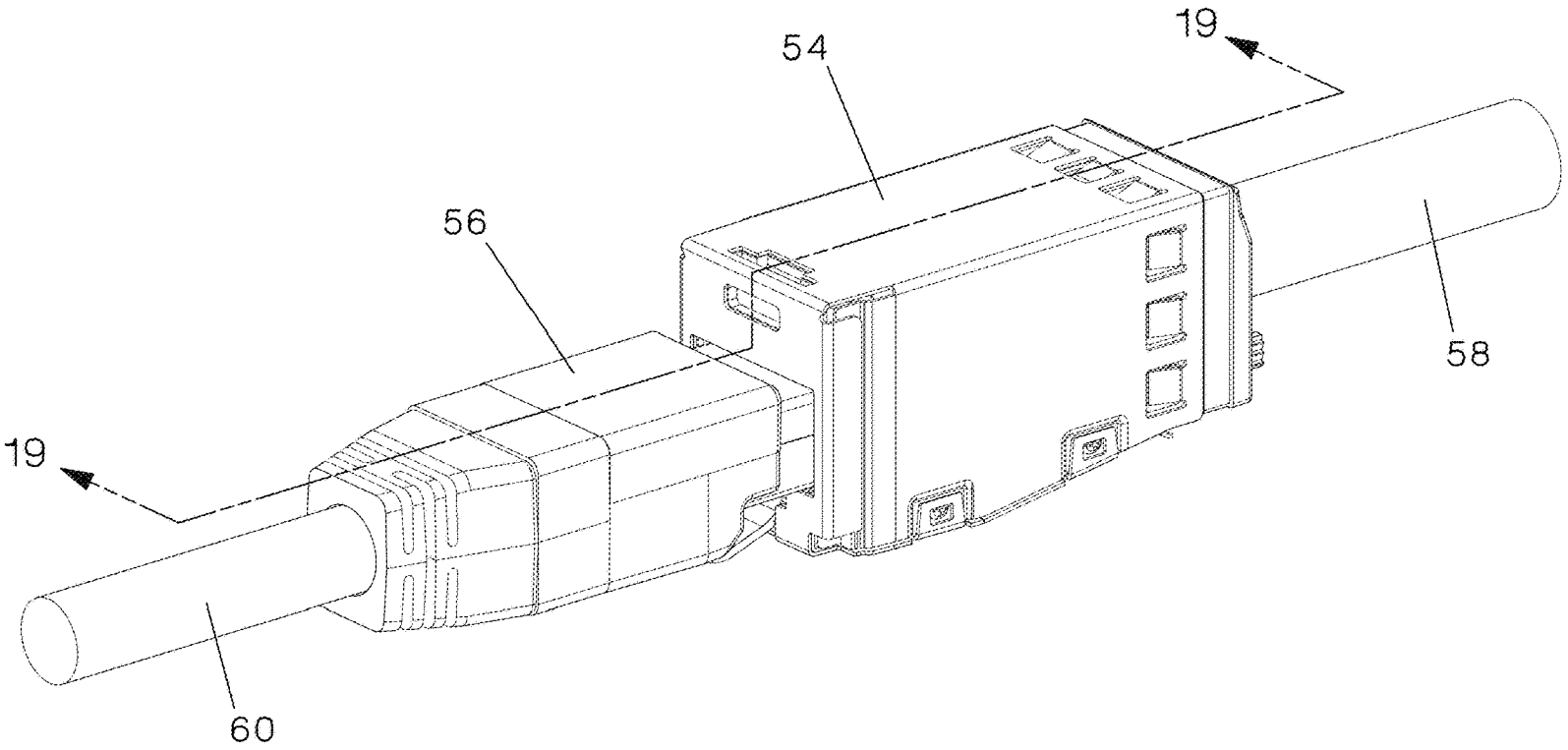
FIG. 18 is an isometric view of the shielded RJ45 network jack and shielded RJ45 plug assembly of FIG. 2 in an over-travel state.
Figure 19:
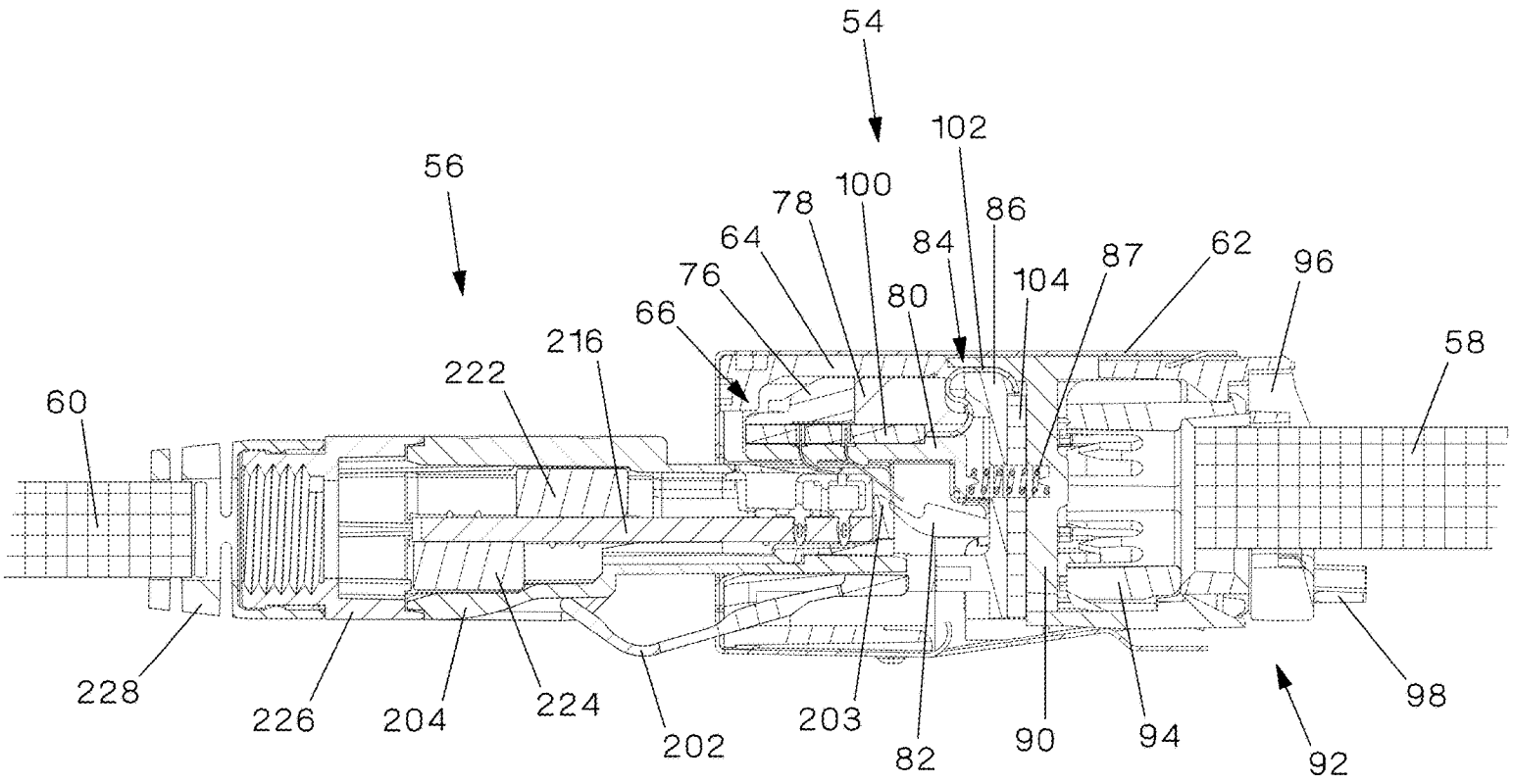
FIG. 19 is a cross-sectional view about line 19-19 of FIG. 18 showing the shielded RJ45 network jack and shielded RJ45 plug assembly in the over-travel state.

FIG. 18 is a top isometric view of mated assembly of shielded RJ45 network jack 54 and shielded RJ45 plug assembly 56 and respective cables 58 and 60 in an over-travel state. The over-travel state allows for insertion of RJ45 plug assembly 56 into shielded RJ45 network jack 54. RJ45 plug assembly 56 is approximately 0.032" further inserted into RJ45 network jack 54 as compared to the mating state shown in FIG. 2. FIG. 19 is a cross-section view, taken along section line 19-19 of FIG. 18 across the mating interface of shielded RJ45 network jack 54 and shielded RJ45 plug assembly 56 in the over-travel state. The relative positioning between the PICs and plug contacts does not change in the over-travel state, although leading contact points 272 and trailing contact points 274 translate accordingly with sled assembly 66. Shielded RJ45 network jack 54 having sled assembly 66 being spring loaded provides another added benefit. It allows for greater separation between the front and the rear PICs while still being mechanically backwards compatible when conventional plugs are mated with shielded RJ45 network jack 54. This is because in the over-travel state this approximately 0.032" further insertion would cause both front odd PICs 68 and front even PICs 70 to fall off the back end of the plug contacts.

Figure 20:
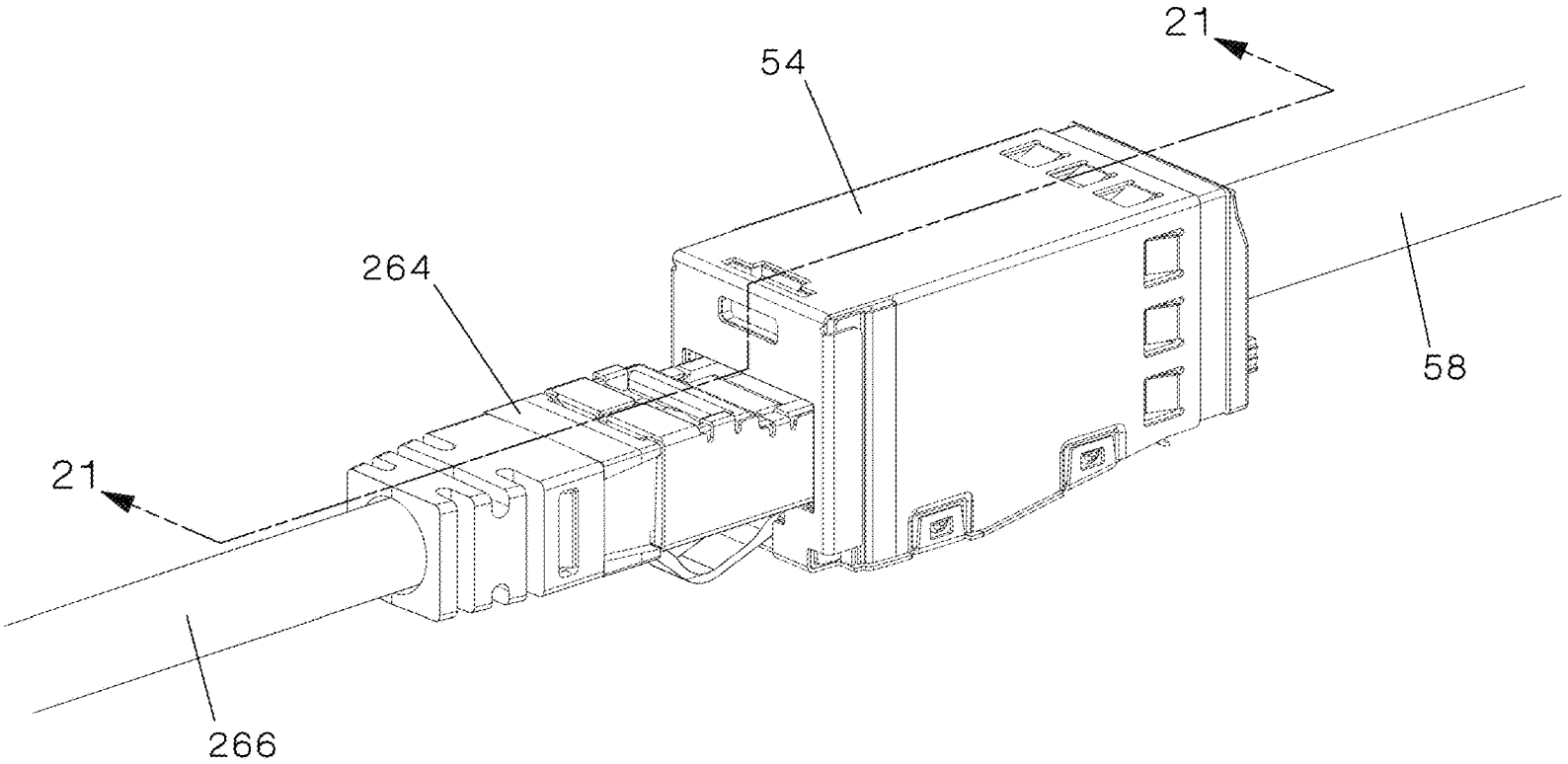
FIG. 20 is a top isometric view of the shielded RJ45 network jack shown in FIG. 2 mated with another embodiment of a shielded RJ45 plug assembly.
Figure 21:
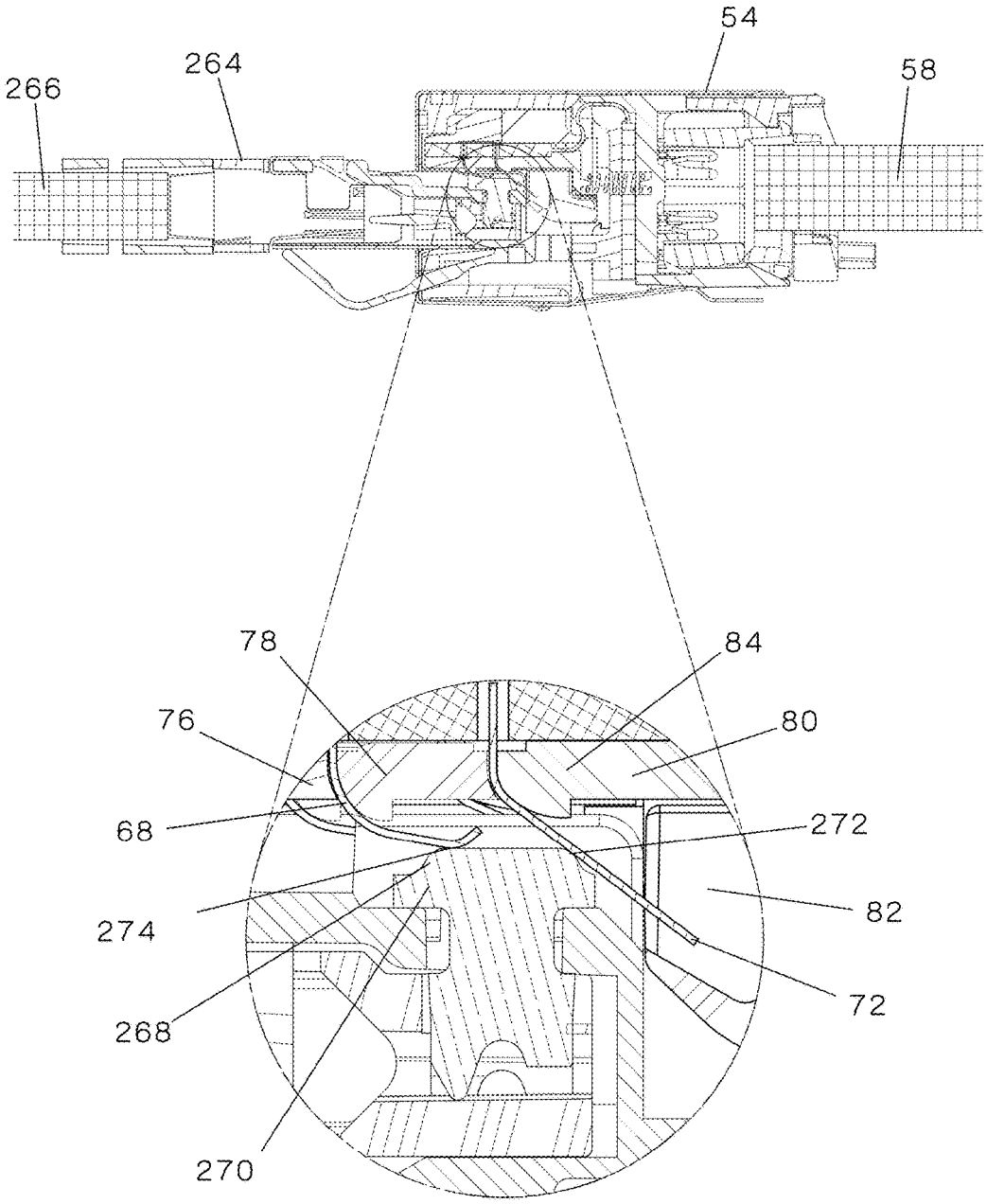
FIG. 21 is a cross-sectional view about line 21-21 of FIG. 20 showing the shielded RJ45 network jack and the shielded RJ45 plug assembly in the mated state.

FIG. 20 is a top isometric view of mated assembly of shielded RJ45 network jack 54 and shielded RJ45 plug assembly 264 and respective cables 58 and 266 in the mated state. FIG. 21 is a cross-section taken from FIG. 20 about section line 21-21 of shielded RJ45 network jack 54 and shielded RJ45 plug assembly 264 and respective cables 58 and 266 in the mated state. It can be seen in FIG. 21 that front odd PICs 68 and front even PICs 70 are on trailing edge 268 of plug contacts 270. If shielded RJ45 plug assembly 264 were inserted an extra 0.032" into the port of shielded RJ45 network jack 54 and sled assembly 66 was not allowed to translate accordingly that 0.032", then front odd PICs 68 and front even PICs 70 may get behind trailing edge 268 and potentially get snagged and damaged.

The NEXT requirement between pairs 3-6 and 4-5 of a mated connector is the most difficult to satisfy. This is because the inherent crosstalk between pairs 3-6 and 4-5 in an RJ45 plug is the highest of all possible pair combinations. A traditional RJ45 plug and jack will have eight plug contacts arranged to mate with eight PICs in the jack at the plug/jack interface. The crosstalk compensation elements in a traditional RJ45 jack are positioned as close as possible to the plug/jack interface to minimize the distance between the crosstalk generation in the plug and the crosstalk compensation in the jack. For NEXT compensation between pairs 3-6 and 4-5, this is especially critical.

Figure 22:
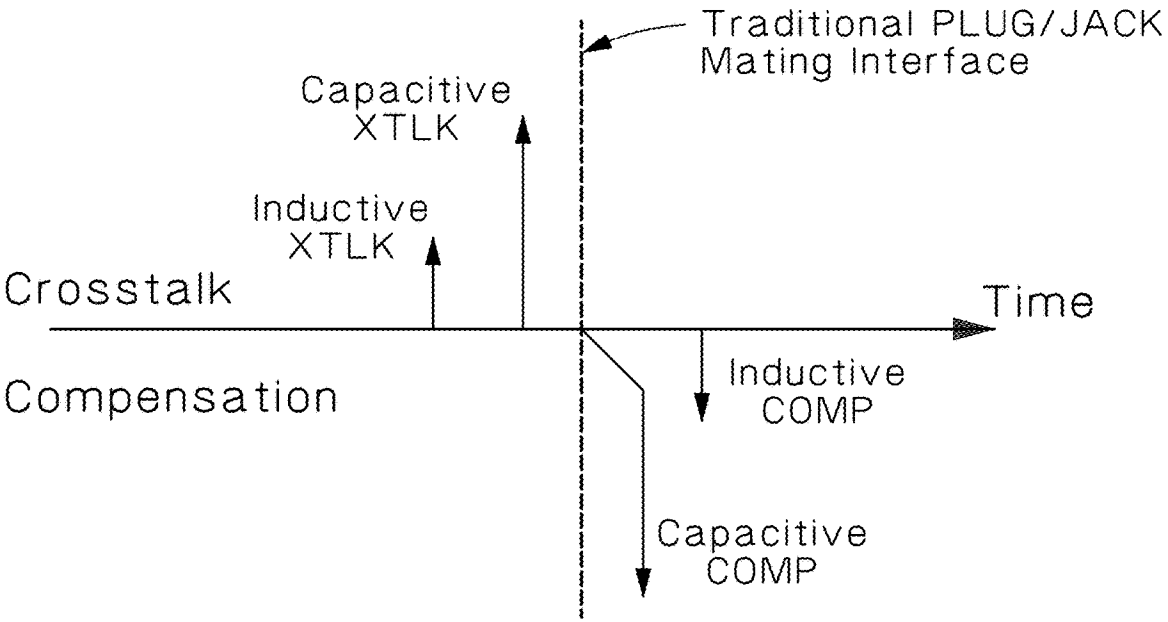
FIG. 22 is a vector plot showing the relative location in time of crosstalk.

The ideal implementation of NEXT compensation in a traditional mated RJ45 connector will position the capacitive compensation directly at the plug/jack interface, for example through a stub connection. Inductive compensation is then positioned along the current paths within the jack either along the PICs or along the traces on a jack printed circuit board. FIG. 22 is a vector plot showing the relative location in time of the crosstalk in the plug and the compensation elements in the jack for the high-quality NEXT compensation implementation in a traditional mated RJ45 connector.

Figure 23:
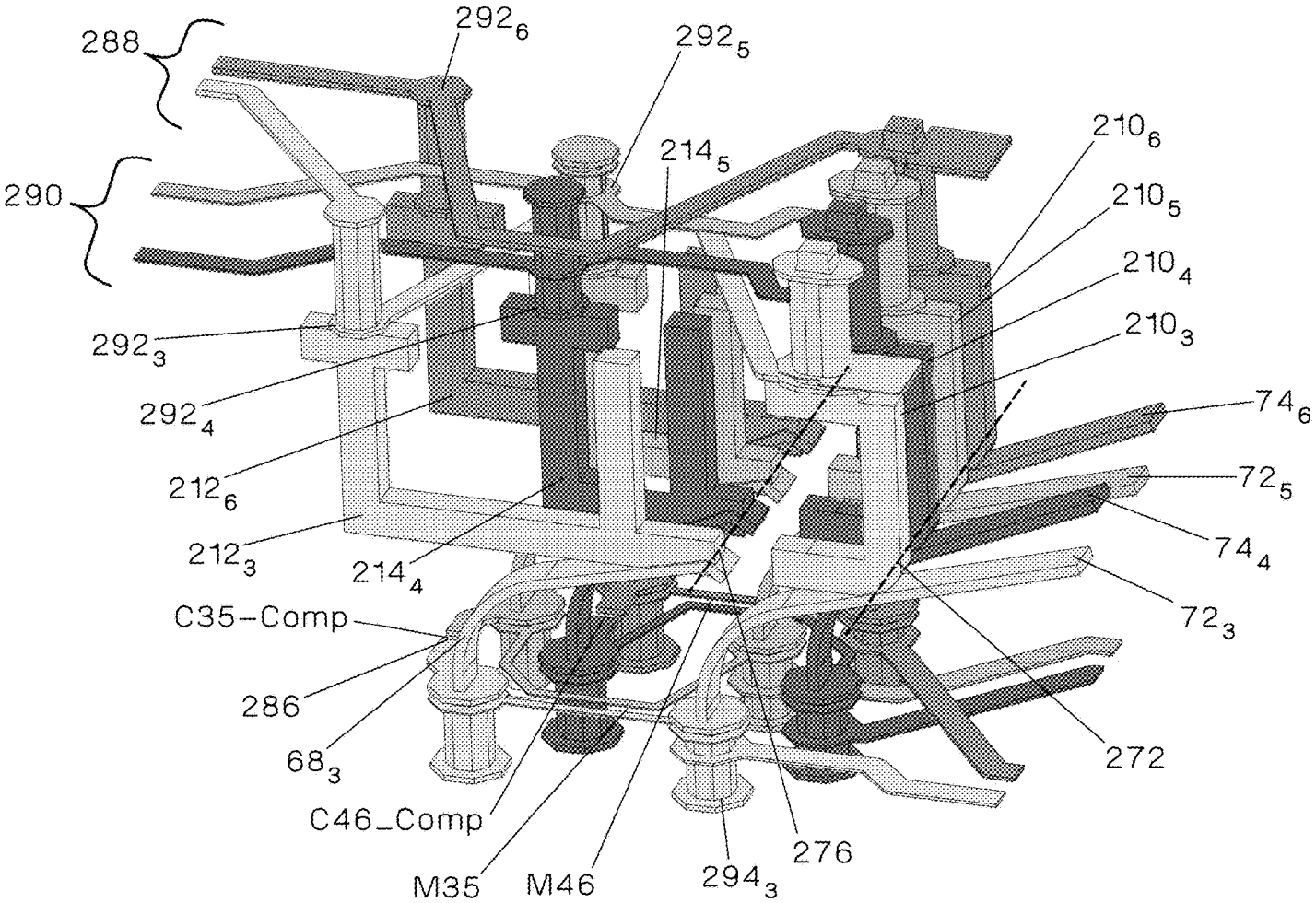
FIG. 23 illustrates an example plug contact arrangement for use in the shielded RJ45 plug assemblies disclosed herein.

FIG. 23, illustrates a detailed view of the mating region between shielded RJ45 network jack 54 mated with shielded RJ45 plug assembly 56, where the plug contacts of shielded RJ45 plug assembly 56 are in contact with the PICs of shielded RJ45 network jack 54. As shown in FIG. 23, shielded RJ45 plug assembly 56 may include additional plug contacts $\mathbf{212}_3$, $\mathbf{214}_4$, $\mathbf{214}_5$, and $\mathbf{212}_6$, which are positioned along the transmission path of the 3-6 and 4-5 pairs on plug PCB 216. These additional plug contacts are located earlier in time relative to the traditional plug contacts $\mathbf{210}_3$, $\mathbf{210}_4$, $\mathbf{210}_5$, and $\mathbf{210}_6$ and are intended to mate with additional PICs $\mathbf{68}_3$, $\mathbf{70}_4$, $\mathbf{68}_5$, and $\mathbf{70}_6$ located within shielded RJ45 network jack 54. By incorporating additional plug contacts and PICs into the connectivity, a second plug/jack interface 276 is created for the 3-6 and 4-5 pairs, which is located earlier in time relative to the traditional plug/jack interface 278. Capacitive compensation 286 in the jack, connected close to the second plug/jack interface 276, reduces and potentially eliminates the delay between the overall crosstalk in the plug and the capacitive compensation in the jack.

Figure 24:
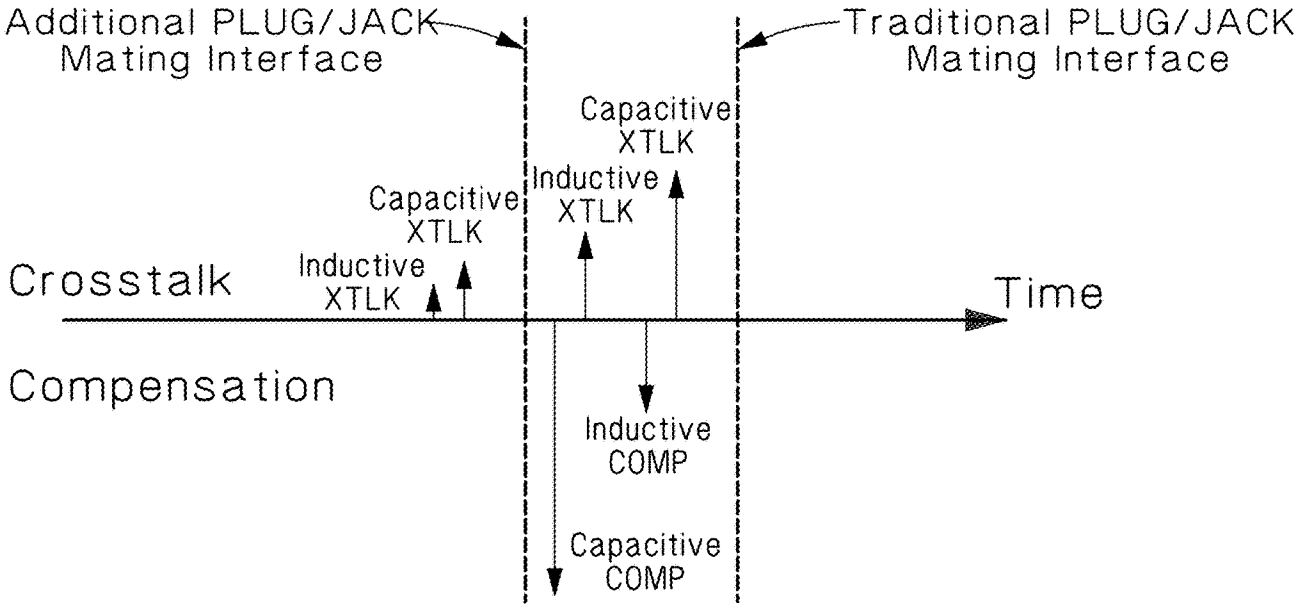
FIG. 24 is another vector plot showing the relative location in time of crosstalk.
Figure 26:
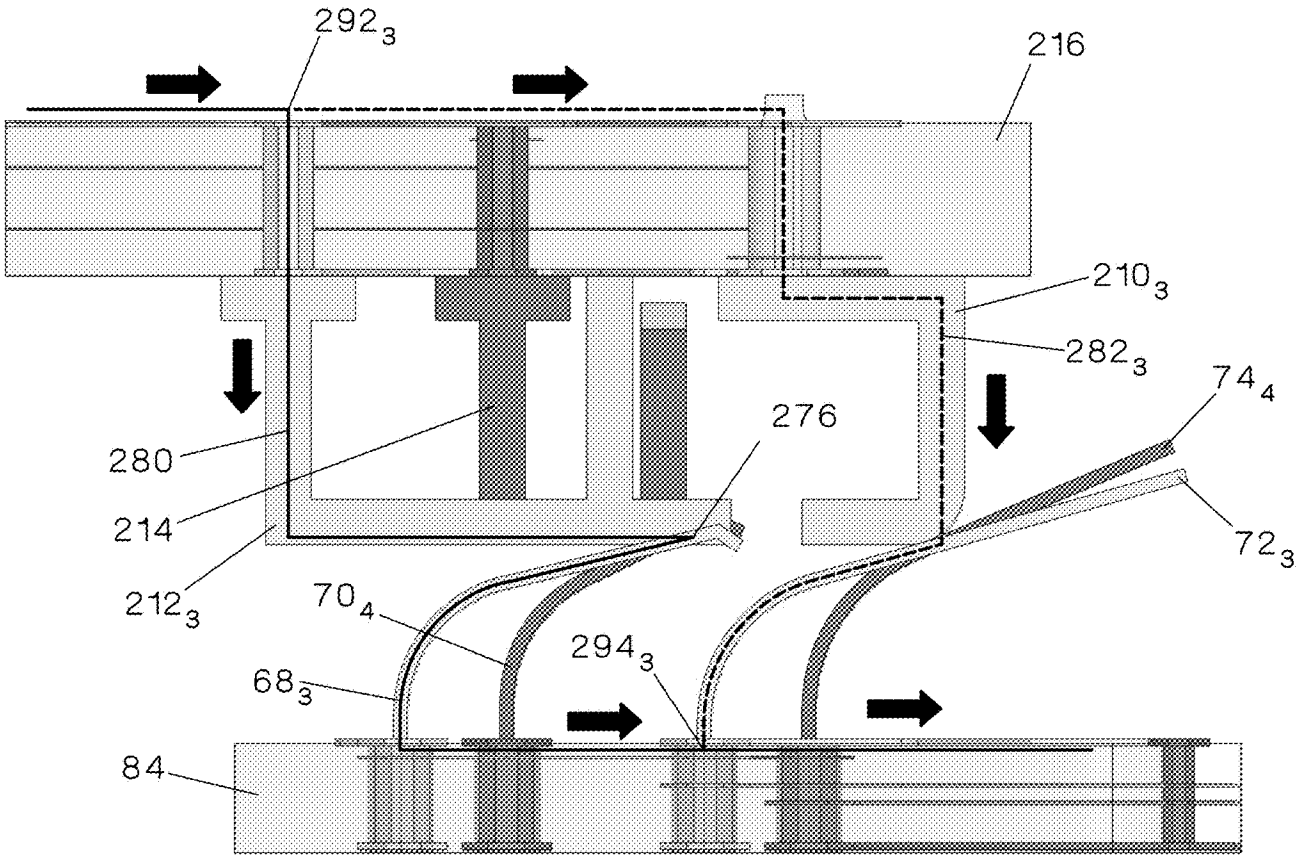
FIG. 26 is a close-up cross-sectional view of a mating section between the shielded RJ45 plug assembly and the shielded RJ45 network jack of FIG. 2.

Similarly, the delay between the crosstalk in the plug and the inductive compensation in the jack can also be reduced or possibly eliminated. The current flow through a traditional mated connector propagates from the cable, through the plug and plug contacts, across the plug/jack interface, through the PICs, and along the transmission paths in the jack to the jack IDCs. By connecting the additional PICs $\mathbf{68}_3$, $\mathbf{70}_4$, $\mathbf{68}_5$, and $\mathbf{70}_6$ to the traditional PICs $\mathbf{72}_3$, $\mathbf{74}_4$, $\mathbf{72}_5$, and $\mathbf{74}_6$ through jack rigid-flex PCB 84 for the 3-6 and 4-5 pairs, a second current path 280 (FIG. 26) across the second plug/jack interface 276 is created. Consider a signal propagating along conductor 3 of pair 3-6 from the plug toward the jack from the perspective of FIG. 26 which is a side view of the mated connectivity. When the signal propagating through the plug reaches the additional plug contact $\mathbf{212}_3$ at location $\mathbf{292}_3$ shown in FIG. 26, a portion of the current will flow through the additional plug contacts, across the second plug/jack interface 276, through the additional front odd PIC $\mathbf{68}_3$, and into jack rigid-flex PCB 84. A portion of the current will continue to propagate along the traditional current path $\mathbf{282}_3$ through plug PCB 216 and traditional plug contact $\mathbf{210}_3$, across the traditional plug/jack interface, through the traditional rear odd PIC $\mathbf{72}_3$, and into jack rigid-flex PCB 84. Within jack rigid-flex PCB 84, the parallel current paths are recombined into a single transmission path at or after the location where the traditional PICs engage jack rigid-flex PCB 84 shown as location $\mathbf{294}_3$ in FIG. 26. Similarly, parallel current paths are implemented for conductors 4, 5, and 6 across the plug jack mating interfaces. Inductive compensation 284 is now being implemented on jack rigid-flex PCB 84 along the parallel current path between the additional PICs $\mathbf{68}_3$, $\mathbf{70}_4$, $\mathbf{68}_5$, $\mathbf{70}_6$ and the traditional PICs $\mathbf{72}_3$, $\mathbf{74}_4$, $\mathbf{72}_5$, $\mathbf{74}_6$. In this arrangement, the delay between the crosstalk in the plug and the inductive compensation in the jack is significantly reduced and potentially eliminated. FIG. 24 is a vector plot showing the relative location in time of the crosstalk in the plug and the compensation elements in the jack. Comparing the vector plots of FIG. 22 and FIG. 24, it is evident that the embodiments of the present invention can provide a significant improvement in the mated NEXT performance for pairs 3-6 and 4-5. This technique can be implemented for NEXT compensation of any possible pair combination if needed.

Figure 25:
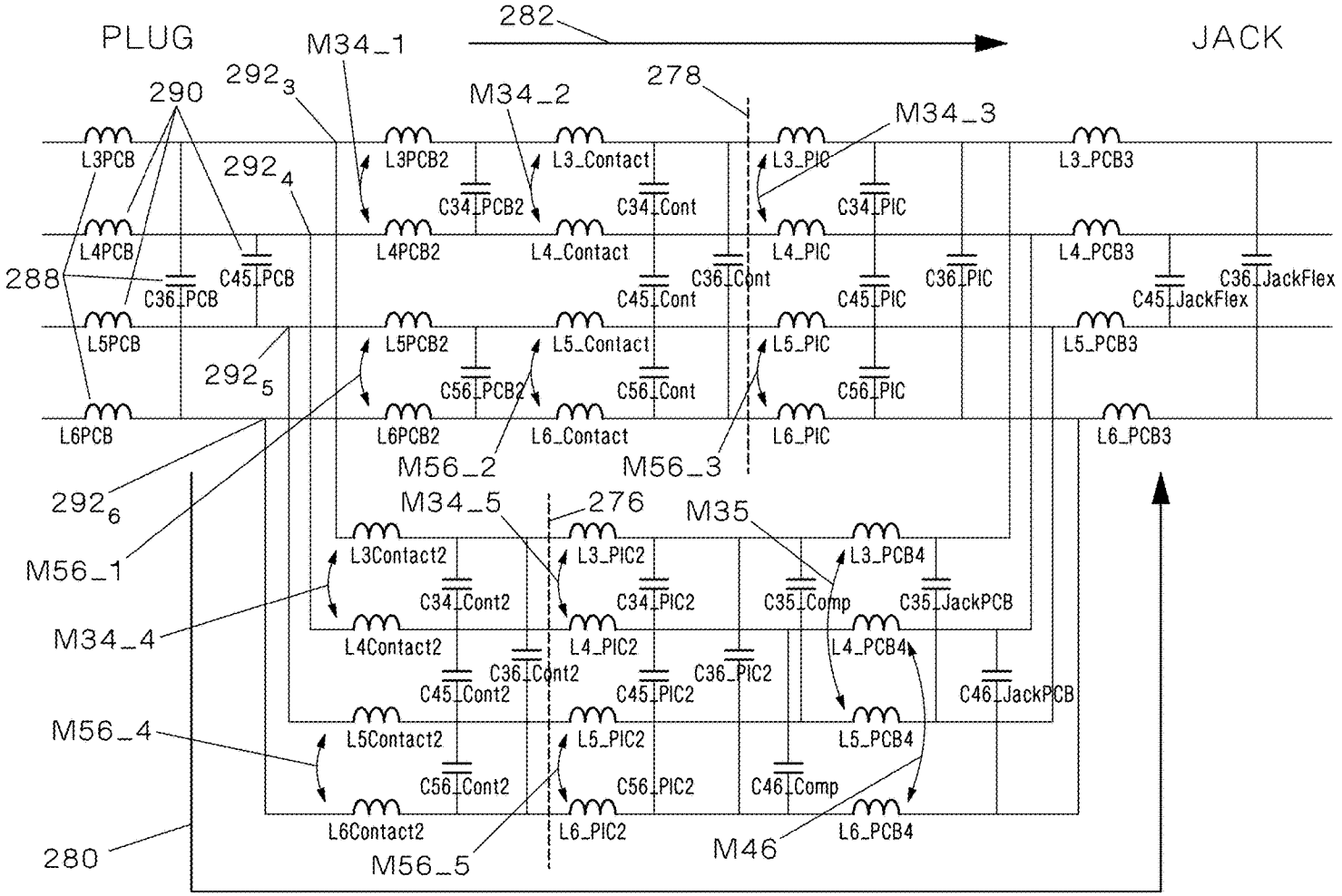
FIG. 25 is a schematic view of parallel current paths when the shielded RJ45 plug assembly and the shielded RJ45 network jack of FIG. 2 are mated.
Figure 34:
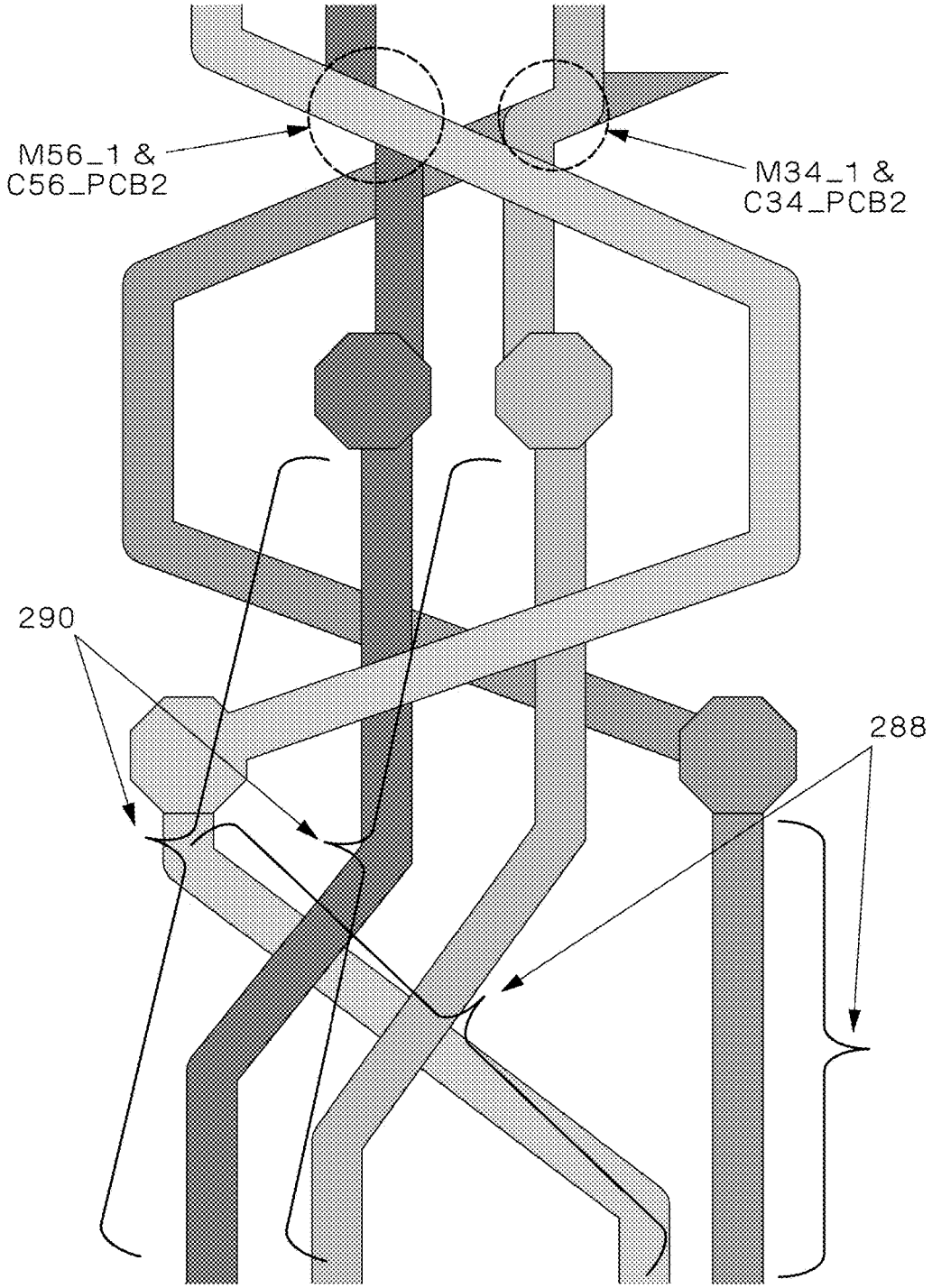
FIG. 34 is a top view showing superimposed traces of various layers of the PCB assembly included in shielded RJ45 plug assembly shown in FIG. 2.

FIG. 25 is a schematic view of the parallel current paths 280 and 282 when shielded RJ45 plug assembly 56 and shielded RJ45 network jack 54 are mated. FIG. 25 shows the intentional interactions between pair 3-6 and pair 4-5. Such interactions can be applied to other pair combinations to improve performance. The differential transmission path 288 of pair 3-6 beginning in plug PCB 216 is represented by discrete components L3PCB, L6PCB, and C36PCB. The differential transmission path 290 of pair 4-5 beginning in the plug PCB 216 is represented by discrete components L4PCB, L5PCB, and C45PCB. The implementation of these transmission paths is shown in FIG. 34 which is a top view of the 3-6 and 4-5 pairs on plug PCB 216.

Traditional current path 282 continues from differential transmission paths 288 and 290 through plug PCB 216 toward the nose of the plug and the traditional plug/jack interface 278. Along this path, inductive and capacitive crosstalk is introduced to produce the appropriate amount of NEXT and FEXT between pairs 3-6 and 4-5 in the plug. A portion of this crosstalk can be seen in FIG. 25 as inductive coupling M34_1, M56_1 and C34_PCB2, C56_PCB2 which is implemented on the plug PCB 216 shown in FIG. 34. Another portion of the required crosstalk in the plug is introduced by the traditional plug contacts $\mathbf{210}_3$, $\mathbf{210}_4$, $\mathbf{210}_5$, and $210_6$. The coupling between these plug contacts is represented in FIG. 25 by inductive coupling M34_2 and M56_2 along with the capacitive coupling C34_Cont and C56_Cont. Plug contacts $210_3$, $210_4$, $210_5$, and $210_6$ mate with the traditional PICs $72_3$, $74_4$, $72_5$, and $74_6$ respectively at the traditional plug jack interface 278. Discrete components L3_PIC, L6_PIC, and C36_PIC represent PICs 72 and components L4_PIC, L5_PIC, and C45_PIC represent PICs 74. The crosstalk between the traditional PICs is represented by capacitors C34_PIC and C56_PIC, along with the inductive coupling M34_3 and M56_3. The traditional plug contacts, traditional plug jack interface, and traditional PICs are also visible in FIG. 23 which is a front trimetric view of the mated assembly for pairs 3-6 and 4-5.

Figure 27:
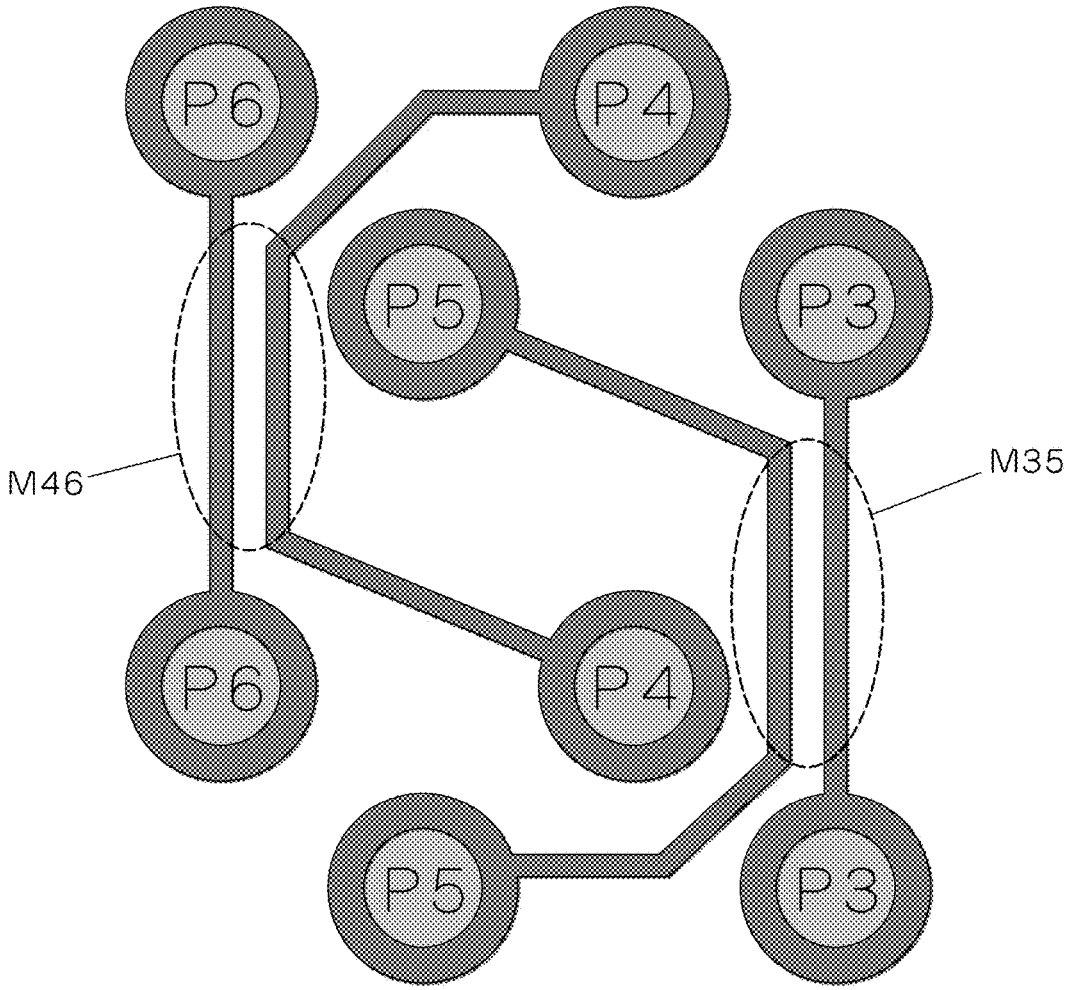
FIG. 27 illustrates a trace arrangement on the PCB assembly included in shielded RJ45 plug assembly shown in FIG. 2 to create inductive compensation.

The second current path 280 branches off from differential transmission paths 288 and 290 at location 292 through additional plug contacts $212_3$, $214_4$, $214_5$, and $212_6$ towards the second plug/jack interface 276. Additional plug contacts $212_3$, $214_4$, $214_5$, and $212_6$ along with the coupling between the contacts are shown schematically in FIG. 25. Discrete components L3_Contact, L6_Contact, and C36_Cont represent plug contacts $212_3$ and $212_6$ and components L4Contact, L5Contact, and C45_Cont represent plug contacts $214_4$ and $214_5$. The crosstalk between the additional plug contacts is represented by capacitors C34_Cont and C56_Cont, along with the inductive coupling M34_4 and M56_6. Plug contacts $212_3$, $214_4$, $214_5$, and $212_6$ mate with the additional PICs $68_3$, $70_4$, $68_5$, and $70_6$ respectively at the second plug jack interface 276. Discrete components L3_PIC2, L6_PIC2, and C36_PIC2 represent PICs $68_3$ and 706 and components L4_PIC2, L5_PIC2, and C45_PIC2 represent PICs $70_4$ and $68_5$. The crosstalk between the additional PICs is represented by capacitors C34_PIC2 and C56_PIC2, along with the inductive coupling M34_5 and M56_5. The additional plug contacts, second plug jack interface, and additional PICs are also visible in FIG. 23 which is a front trimetric view of the mated assembly for pairs 3-6 and 4-5. Continuing along the second current path in FIG. 25, capacitive compensation and inductive compensation are represented by discrete components C35_Comp, C46_Comp, and inductive coupling M35 and M46. These elements are implemented on jack rigid-flex PCB 84 and can be seen in FIG. 23 as well as in FIG. 27 which is a top view of jack rigid-flex PCB 84 showing the trace arrangement for creating inductive compensation. Positioning the inductive and capacitive compensation between the traditional plug jack mating interface and the second plug jack mating interface allows for improved NEXT performance at frequencies up to 2 GHz. These traces in FIG. 27 complete the second current path 280 after which it is reunited with the traditional current path at location 294. Beyond location 294, the differential transmission paths for pair 3-6 and pair 4-5 are routed through jack PCB 84 with a controlled impedance to their respective IDCs 88 with negligible coupling between pairs.

Figure 35:
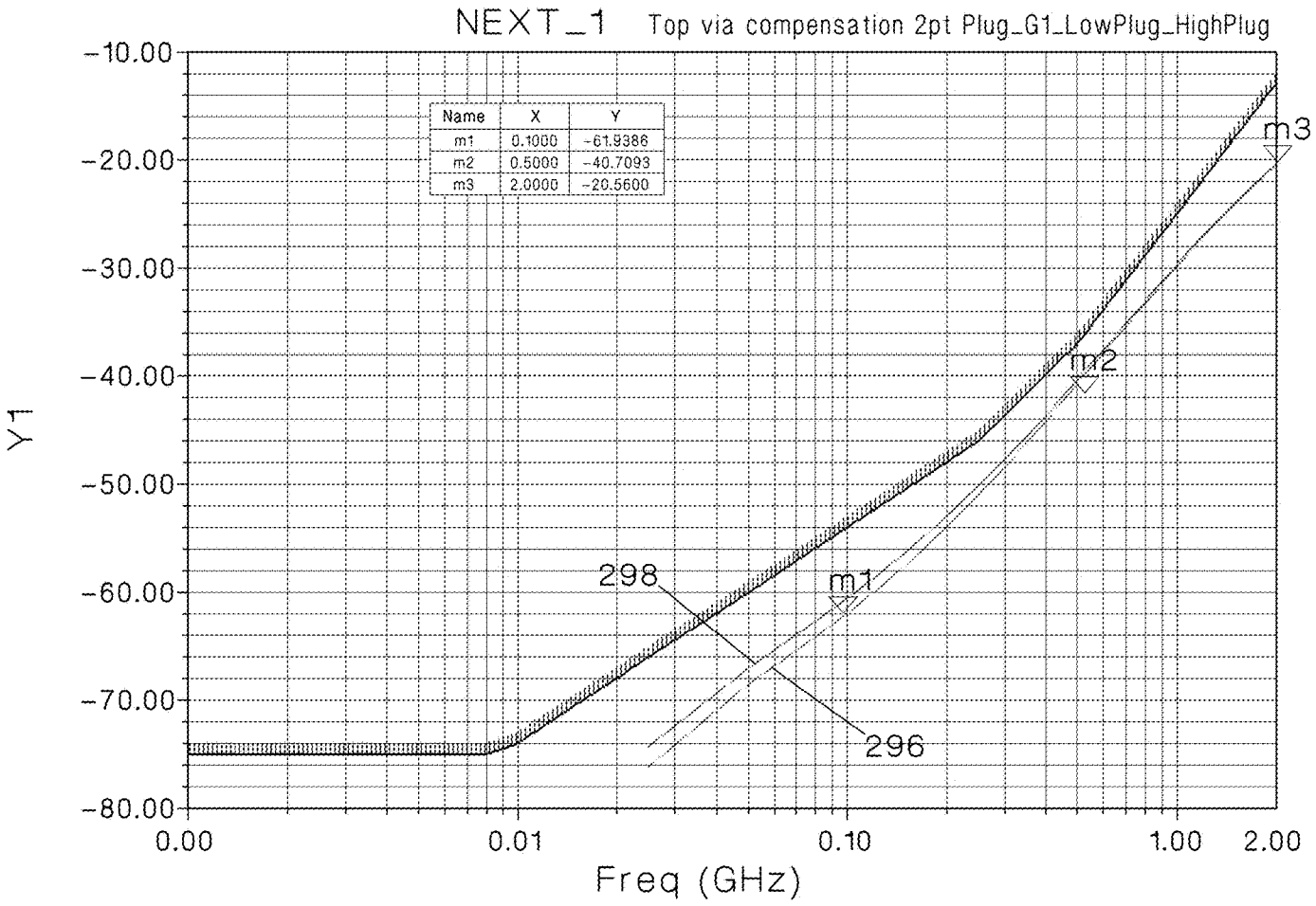
FIG. 35 is a plot of near-end crosstalk (NEXT) response.

FIG. 35 shows the mated NEXT response of the 36-45 pair combination with data markers at 100 MHz, 500 MHz, and 2 GHz, showing over 5 dB of margin across the whole operating frequency range over the entire range of plug characteristics from low to high. NEXT performance line 296 shows the 36-45 NEXT performance when the connector is mated to a "High" plug. NEXT performance line 298 shows the 36-45 NEXT performance when the connector is mated to a "Low" plug.

Figure 28:
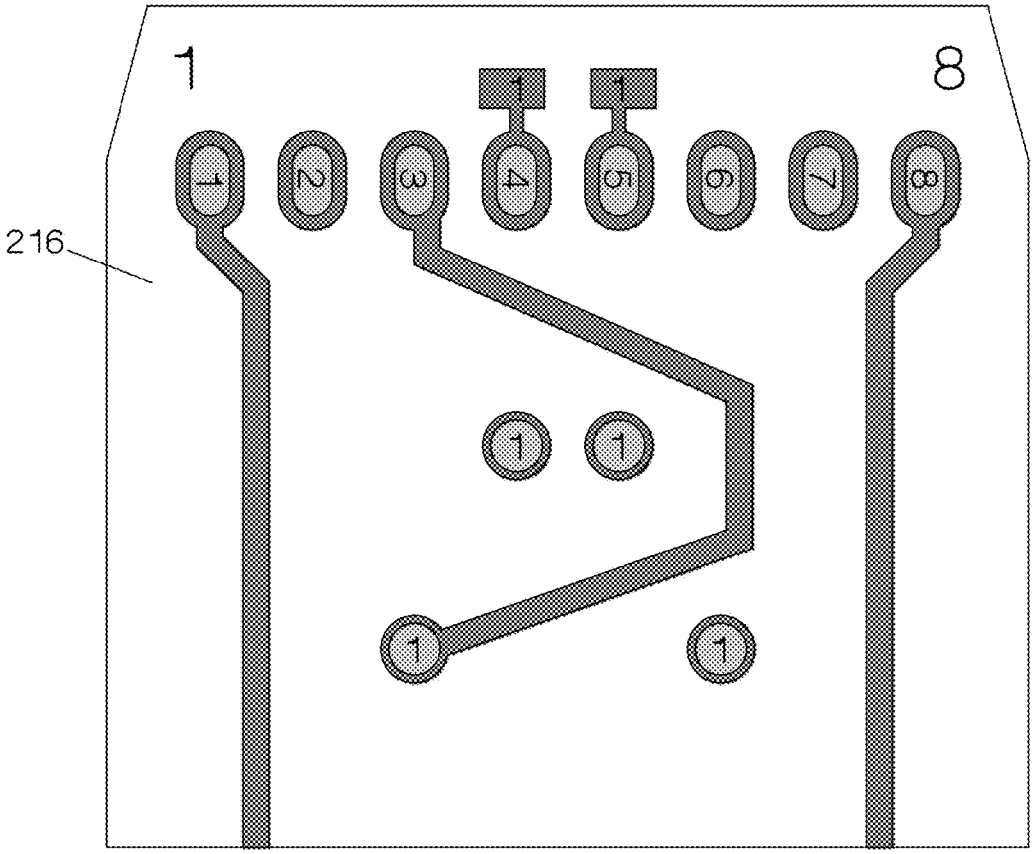
FIG. 28 is a top view showing traces on a first layer of the PCB assembly included in shielded RJ45 plug assembly shown in FIG. 2.
Figure 29:
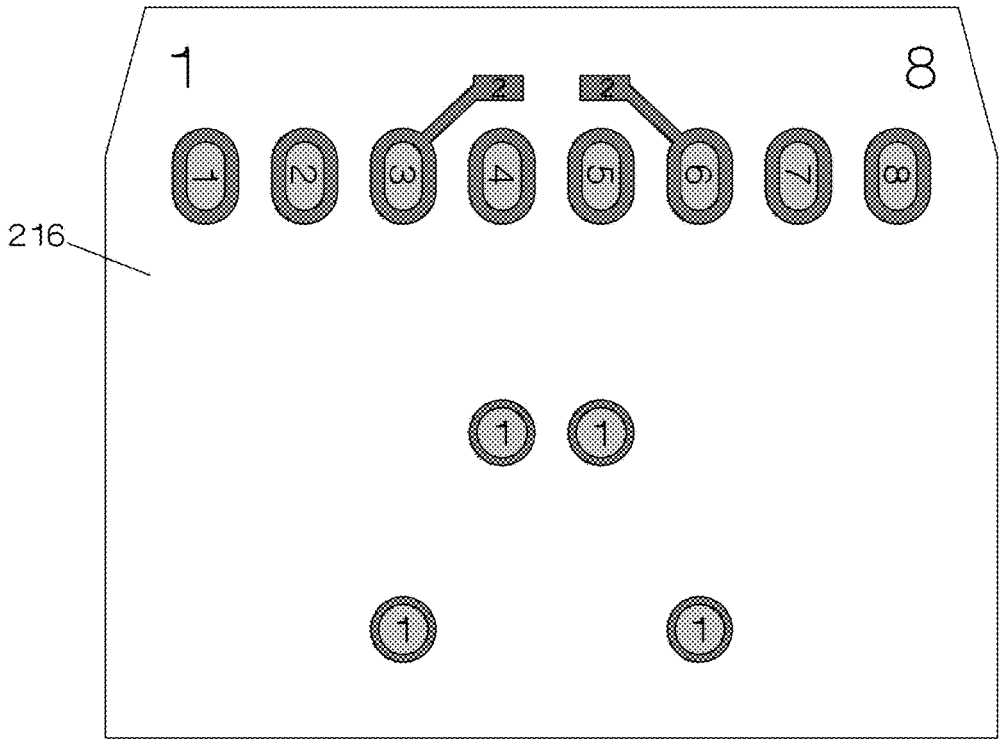
FIG. 29 is a top view showing traces on a second layer of the PCB assembly included in shielded RJ45 plug assembly shown in FIG. 2.
Figure 30:
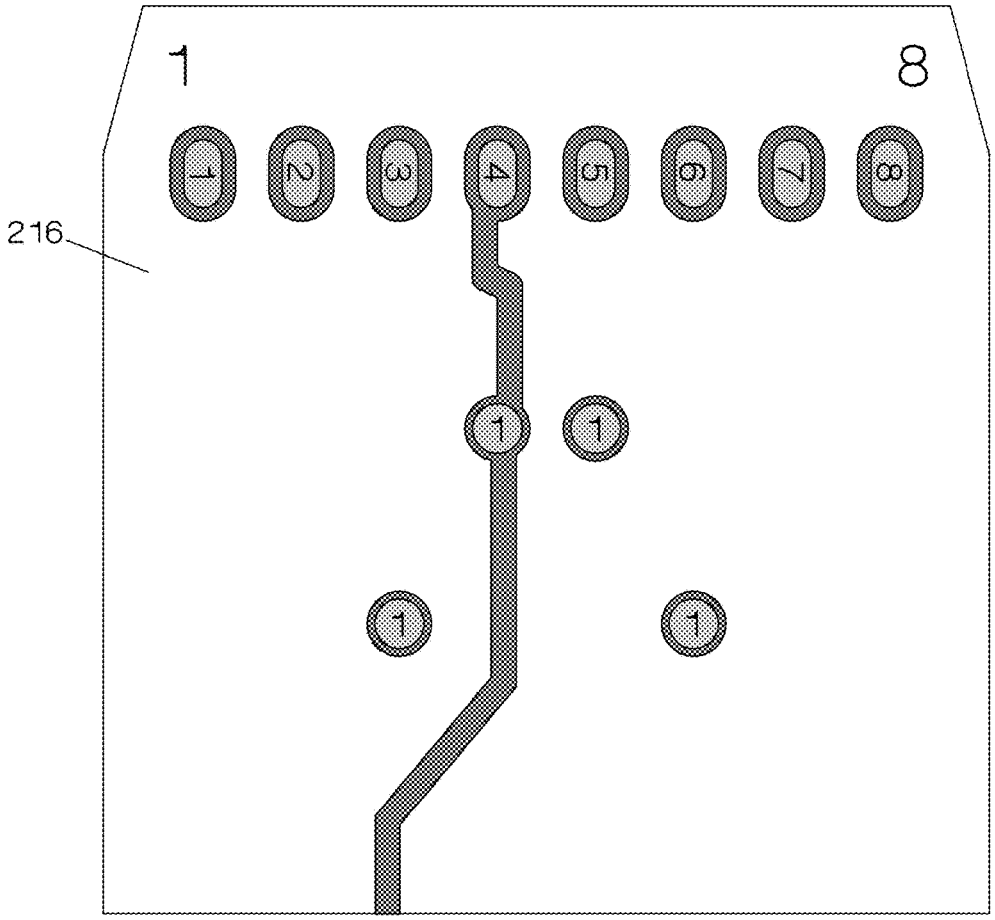
FIG. 30 is a top view showing traces on a third layer of the PCB assembly included in shielded RJ45 plug assembly shown in FIG. 2.
Figure 31:
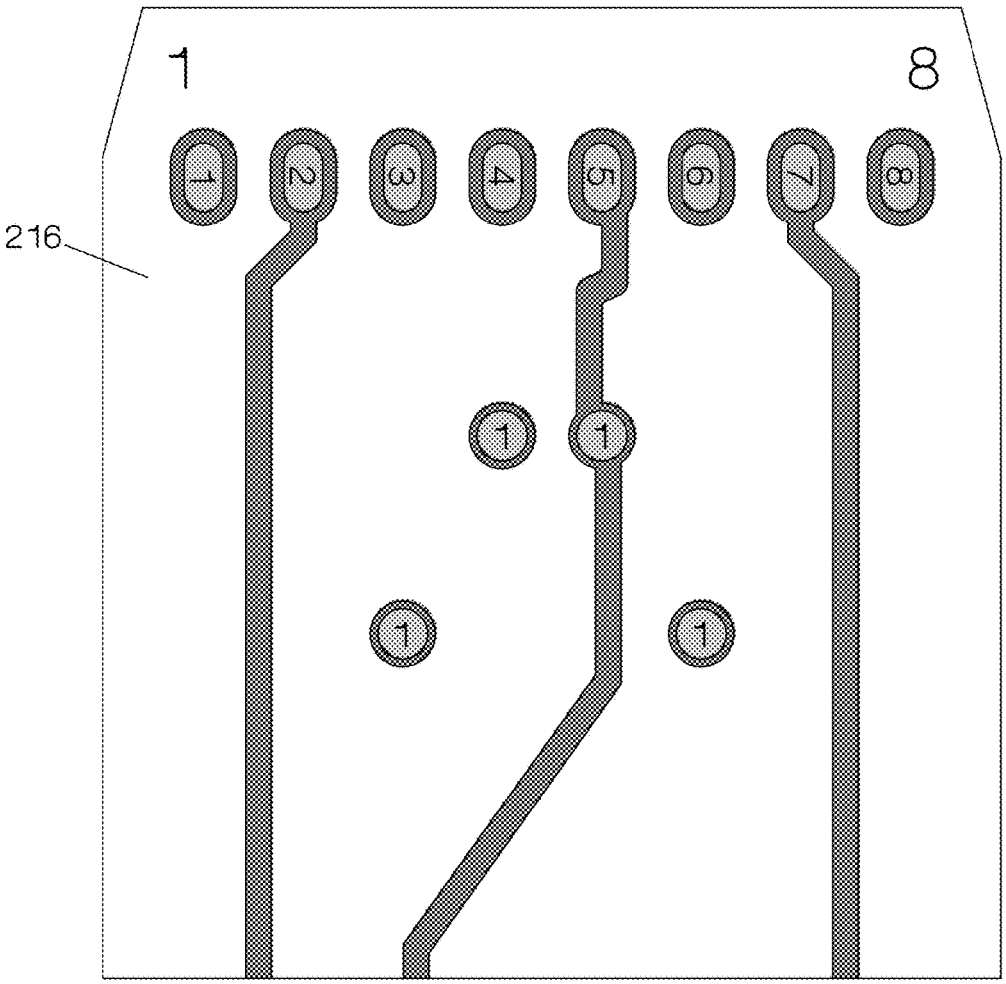
FIG. 31 is a top view showing traces on a fourth layer of the PCB assembly included in shielded RJ45 plug assembly shown in FIG. 2.
Figure 32:
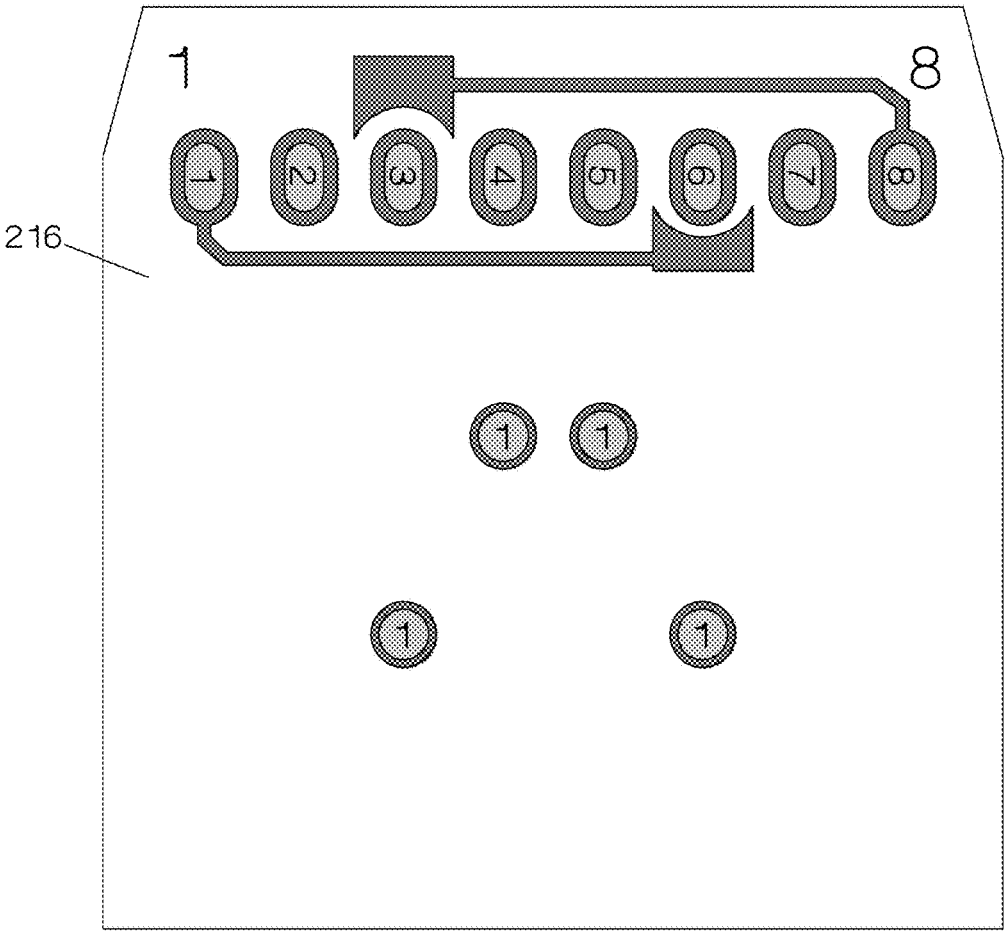
FIG. 32 is a top view showing traces on a fifth layer of the PCB assembly included in shielded RJ45 plug assembly shown in FIG. 2.
Figure 33:
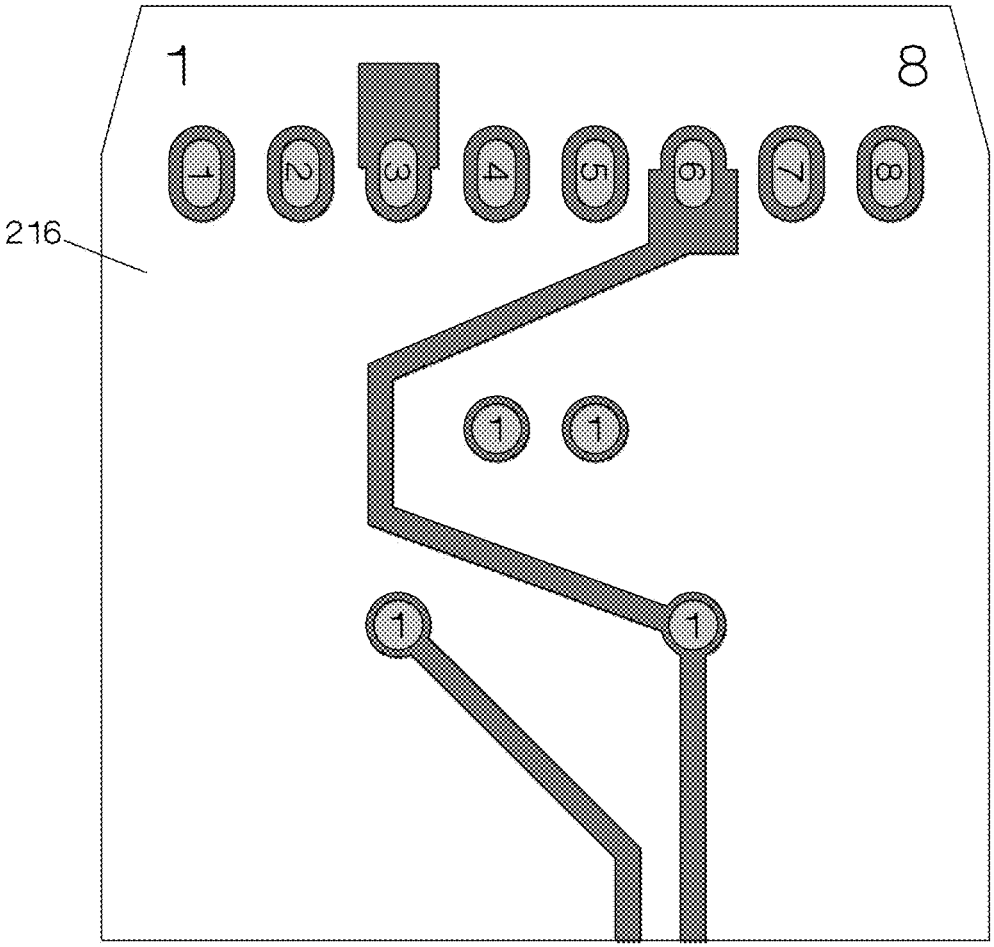
FIG. 33 is a top view showing traces on a sixth layer of the PCB assembly included in shielded RJ45 plug assembly shown in FIG. 2.

FIG. 28 is a top view of traces on the first layer of PCB 216. FIG. 29 is a top view of traces on the second layer of PCB 216. FIG. 30 is a top view of traces on the third layer of PCB 216. FIG. 31 is a top view of traces on the fourth layer of PCB 216. FIG. 32 is a top view of traces on the fifth layer of PCB 216. FIG. 33 is a top view of traces on the sixth layer of PCB 216.

Power over Ethernet (PoE) allows a single cable to provide both electrical power and data connections, which eliminates the need for additional power cables and devices such as transformers and AC outlets. Some non-limiting examples of PoE devices include Voice over IP (VoIP) phones, wireless access points, network routers, switches, industrial devices (controllers, meters, sensors), nurse call stations, IP security cameras, televisions, LED lighting fixtures, remote point of sale kiosks, and physical security devices. PoE was launched into the market in 2003, standardized under IEEE 802.3af, and allowed for a power draw of 12.95 W and 350 mA per pair (Type 1). POE+ was launched into the market in 2009, standardized under IEEE 802.3at, and allowed for a power draw of 25.5 W and 600 mA per pair (Type 2). As the need for more and more power becomes apparent, non-standard applications such as Cisco's Universal Power over Ethernet (UPoE) at 60 W and Power over HDBaseT (100 W), with 1000 mA per pair of current capacity, have arisen. As of 2015 there is a proposed IEEE 802.3bt (PoE++) with 49 W (Type 3) to 100 W (Type 4) of power draw and 600 mA (Type 3) to 1000 mA (Type 4) per pair of power, expected to be available in 2016. In the future, there are potential applications that could require a current capacity of 1500 mA per pair or more.

However, with this new increase in power and standardization of PoE, many connectors were not previously mechanically designed for durability under this electrical load. In a PoE application upon disconnection of the plug and jack connector there is an electrical discharge that can damage the plug and jack mating interface. This electrical discharge can be seen as an electrical arc (spark) or a corona discharge. A spark is a fast, single event that is time independent and may cause a large distinct crater on either the plug contacts or the PICs of the jack module, or both. A corona discharge is a relatively slower event that is time dependent, has multiple events, and causes many shallow craters or pits that erode either the plug contacts or the PICs of the jack module, or both. These effects are worsened after multiple insertions as erosion caused by mechanical abrasion also damages the plug/jack mating interface. IEC 60603-7, requires a minimum of 750 plug insertions into a jack module. Many vendors test to a higher amount of insertion cycles as for some applications 750 plug insertions is relatively low. The effects of this damage are seen in the form of physical damage, electrical interface degradation, and over time, corrosion on the contacts. To quantify these effects, IEC developed test methods IEC 60512-9-3 and IEC 60512-99-001 (Arcing Test Method Standards).

Figure 36:
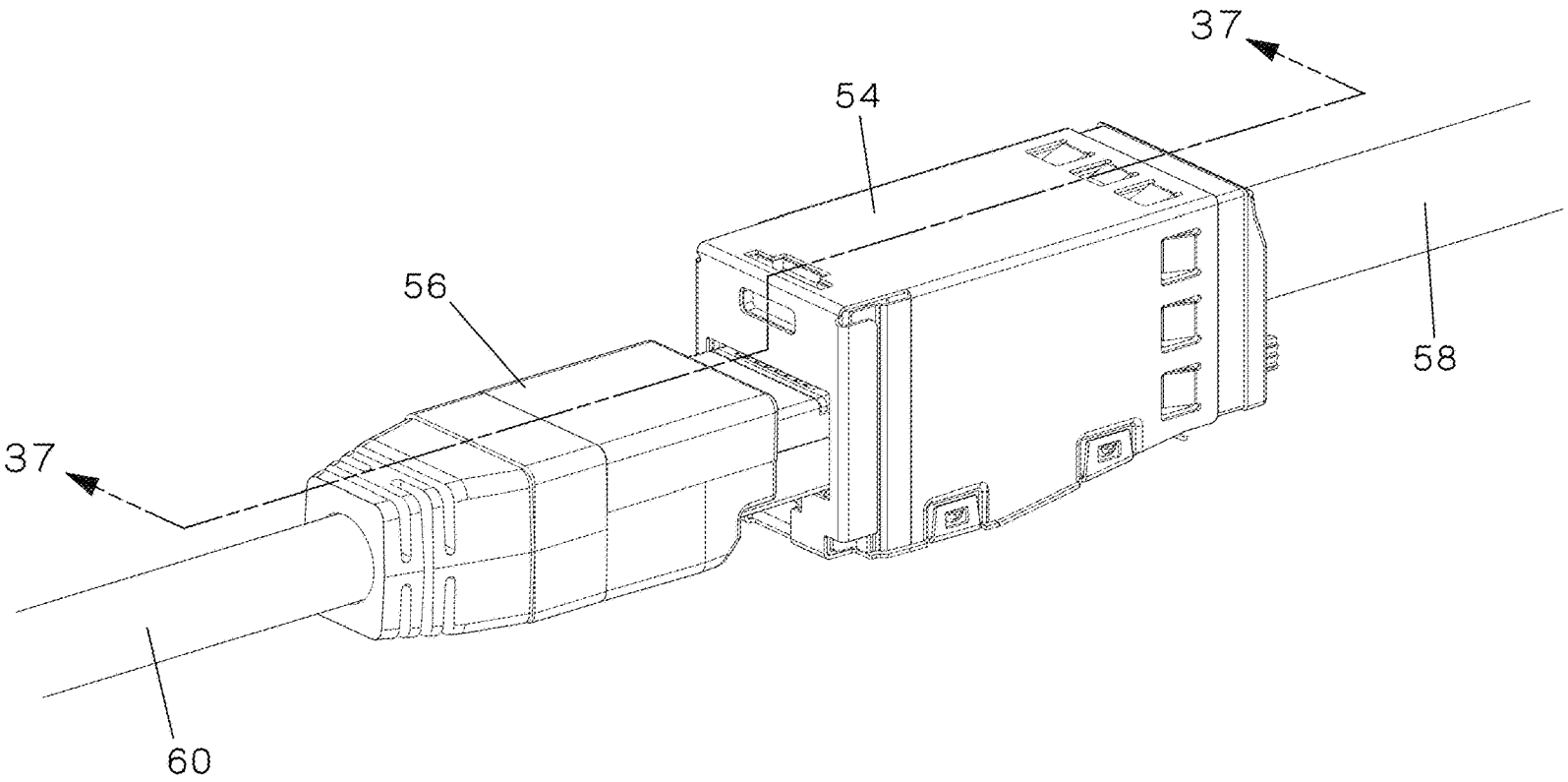
FIG. 36 is a top isometric view of the shielded RJ45 network jack and shielded RJ45 plug assembly of FIG. 2 in a pre-release state.
Figure 37:
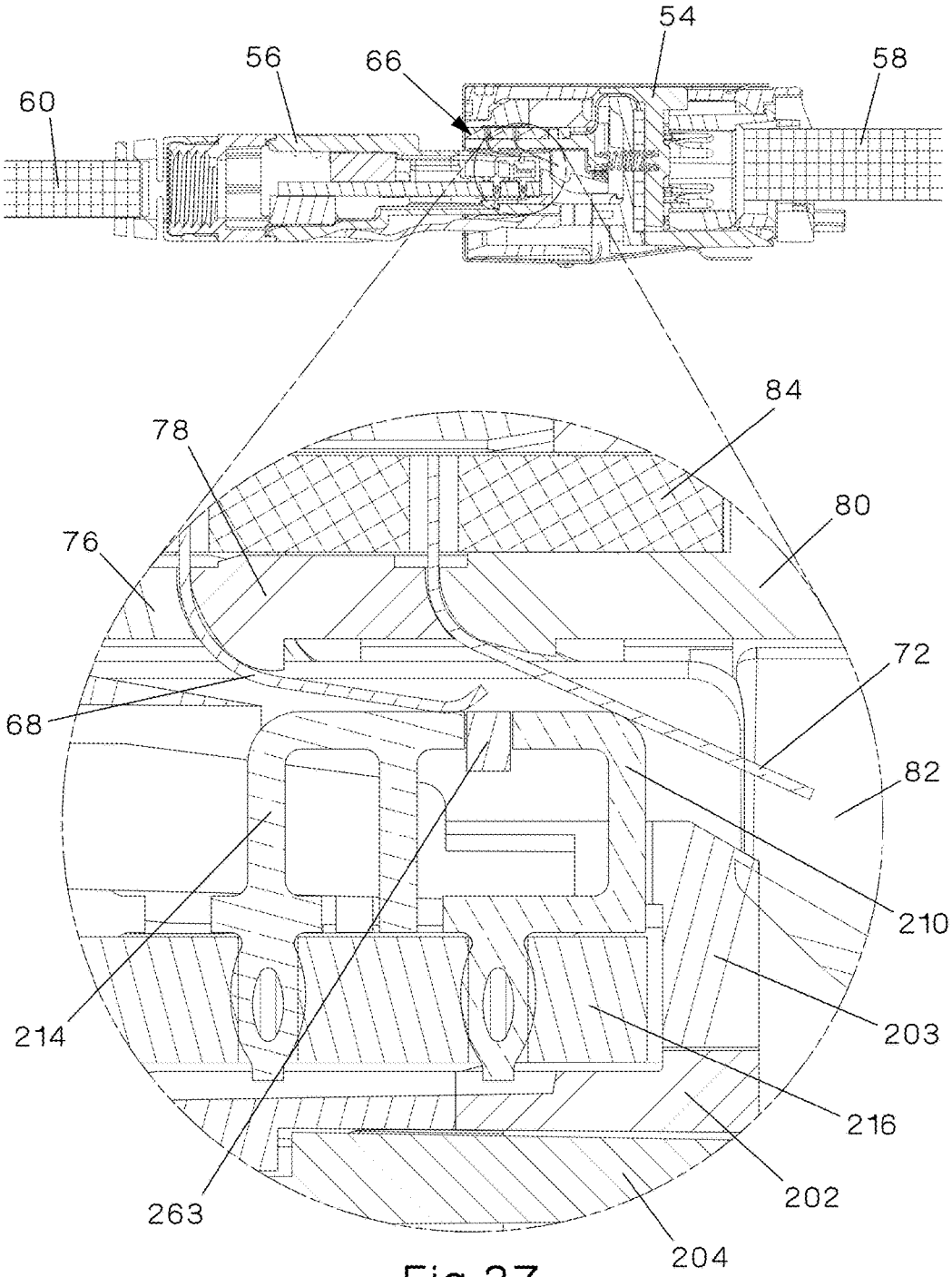
FIG. 37 is a cross-sectional view about line 37-37 of FIG. 36 showing the shielded RJ45 network jack and the shielded RJ45 plug assembly in the pre-release state.

FIG. 36 is a top isometric view of mated assembly of shielded RJ45 network jack 54 and shielded RJ45 plug assembly 56 and respective cables 58 and 60 in a pre-release state. The pre-release state is the state where all PICs within RJ45 network jack 54 are still in contact with the plug contacts of shielded RJ45 plug assembly 56 are still in electrical contact. In the pre-release state, sled assembly 66 is in a fully forward state approximately 0.021" forward from the mated state. This state is the same as the initial insertion state just prior to translating sled assembly 66. FIG. 37 is a cross-section view, taken along section line 37-37 from FIG. 36 across the mating interface of shielded RJ45 network jack 54 and shielded RJ45 plug assembly 56 in the pre-release state.

Figure 38:
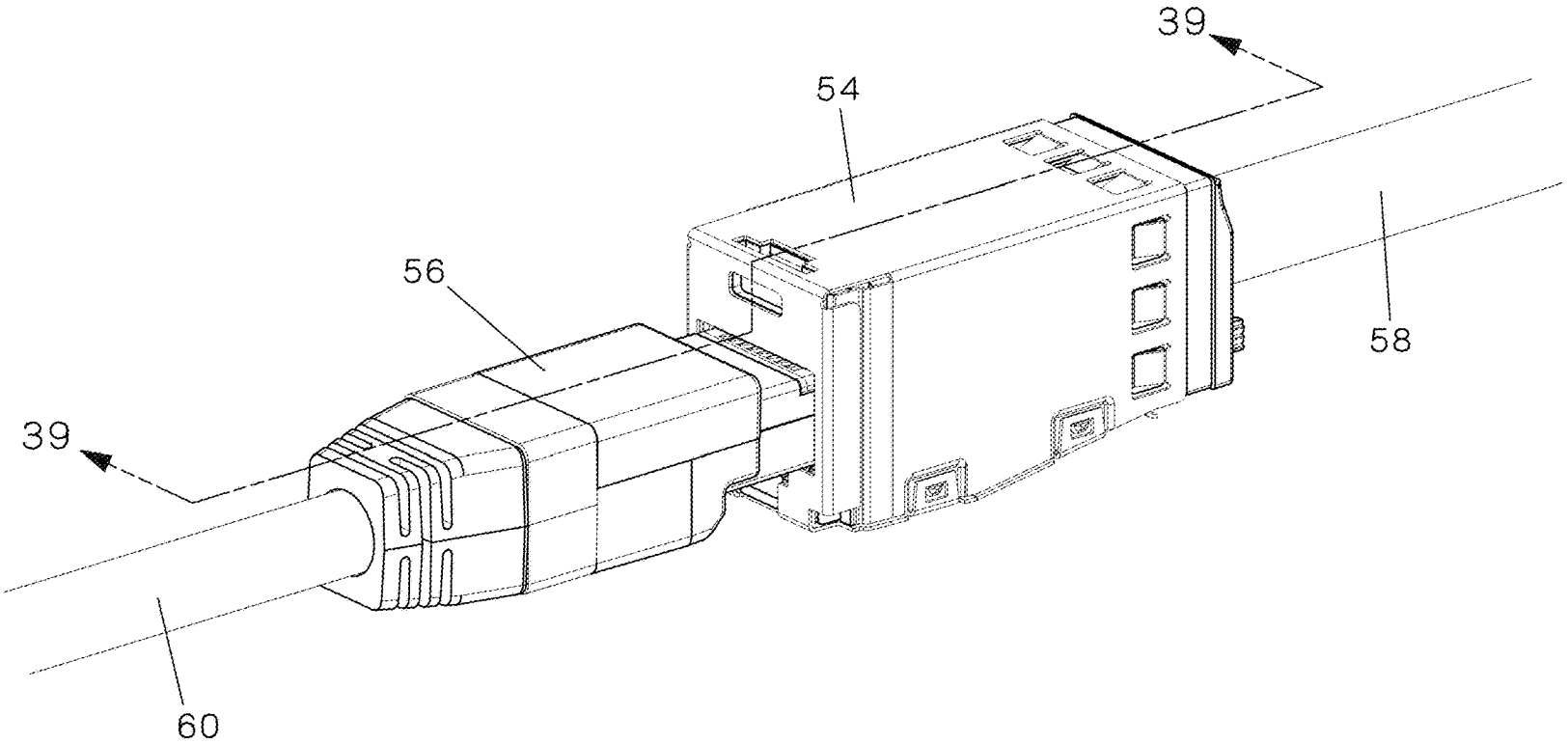
FIG. 38 is a top isometric view of the shielded RJ45 network jack and shielded RJ45 plug assembly of FIG. 2 in a partial release state.
Figure 39:
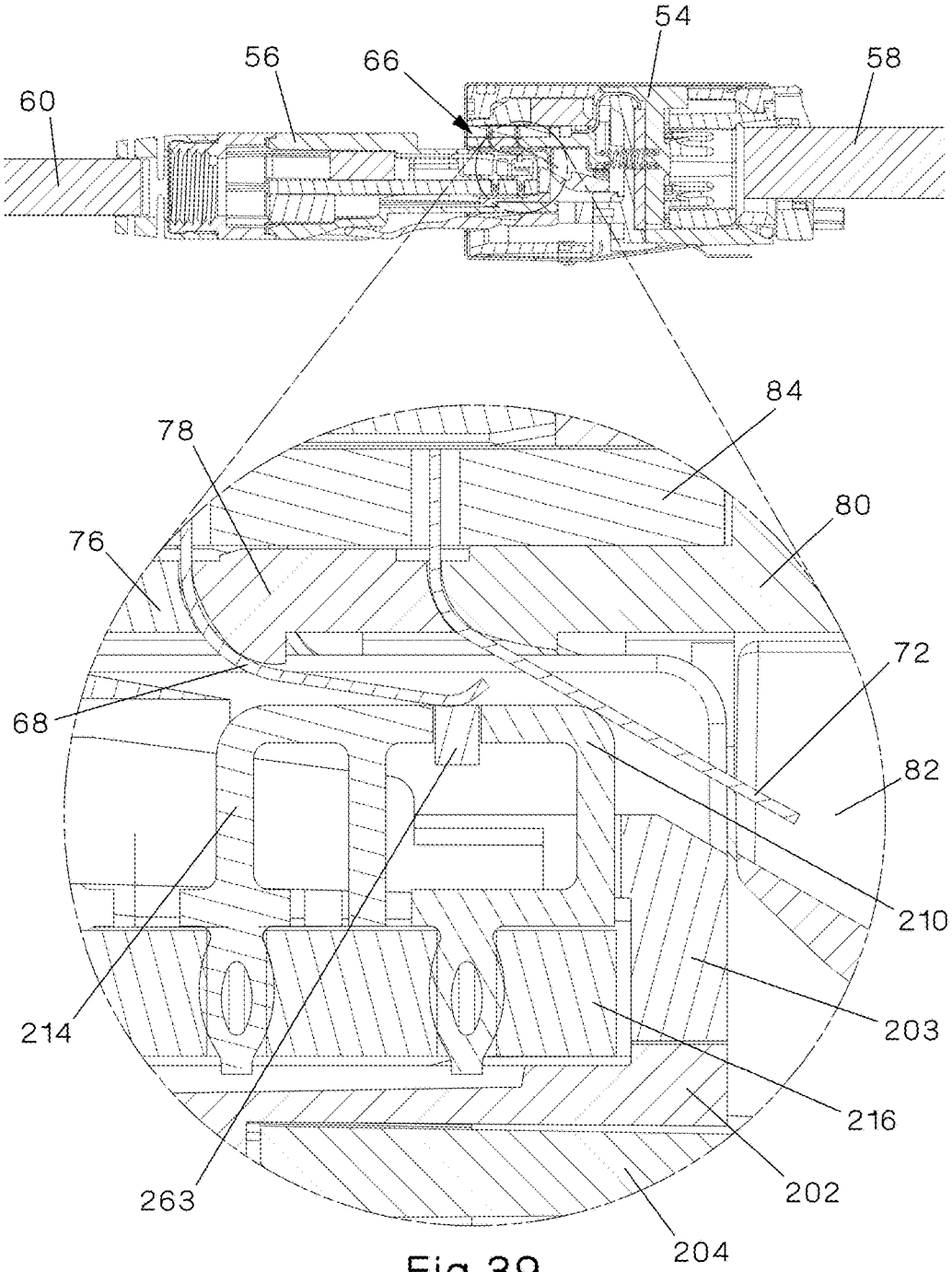
FIG. 39 is a cross-sectional view about line 39-39 of FIG. 38 showing the shielded RJ45 network jack and the shielded RJ45 plug assembly in the partial release state.

FIG. 38 is a top isometric view of mated assembly of shielded RJ45 network jack 54 and shielded RJ45 plug assembly 56 and respective cables 58 and 60 in a partial-release state. The partial-release state is the state where all rear odd PICs 72 and rear even PICs 74 have disconnected from respective plug contacts, but front odd PICS 68 and front even PICS 70 are still in contact with respective plug contacts of shielded RJ45 plug assembly 56. In the partial-release state, sled assembly 66 is in the fully forward state approximately 0.021" forward from the mated state. FIG. 39 is a cross-section view, taken along section line 39-39 from FIG. 38 across the mating interface of shielded RJ45 network jack 54 and shielded RJ45 plug assembly 56 in the pre-release state. In this pre-release state, no electrical discharge has occurred due to a disconnection as there is still a current path through the shielded RJ45 network jack 54 although one of the current paths has been broken.

Figure 40:
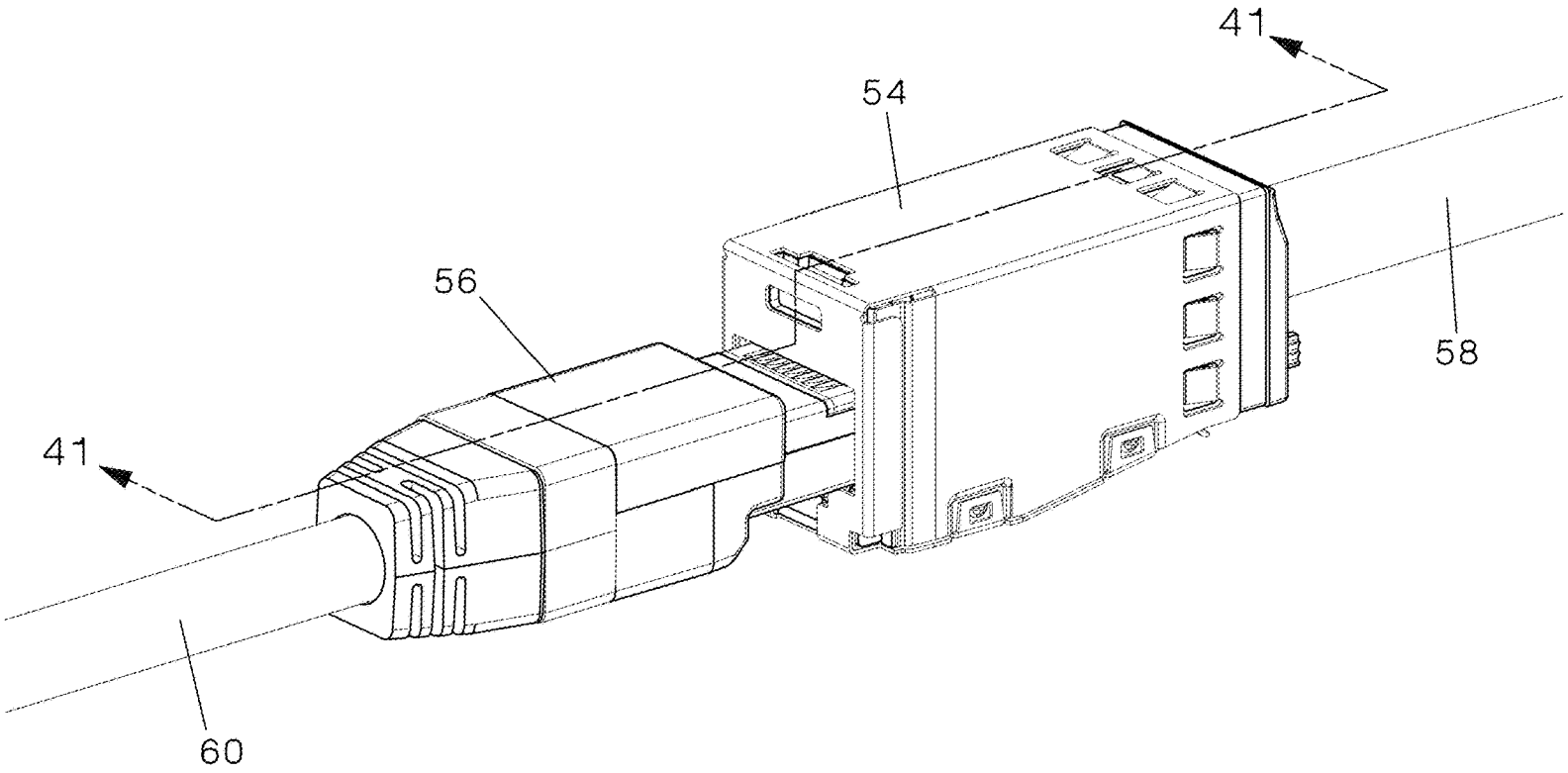
FIG. 40 is a top isometric view of the shielded RJ45 network jack and shielded RJ45 plug assembly of FIG. 2 in a released state.
Figure 41:
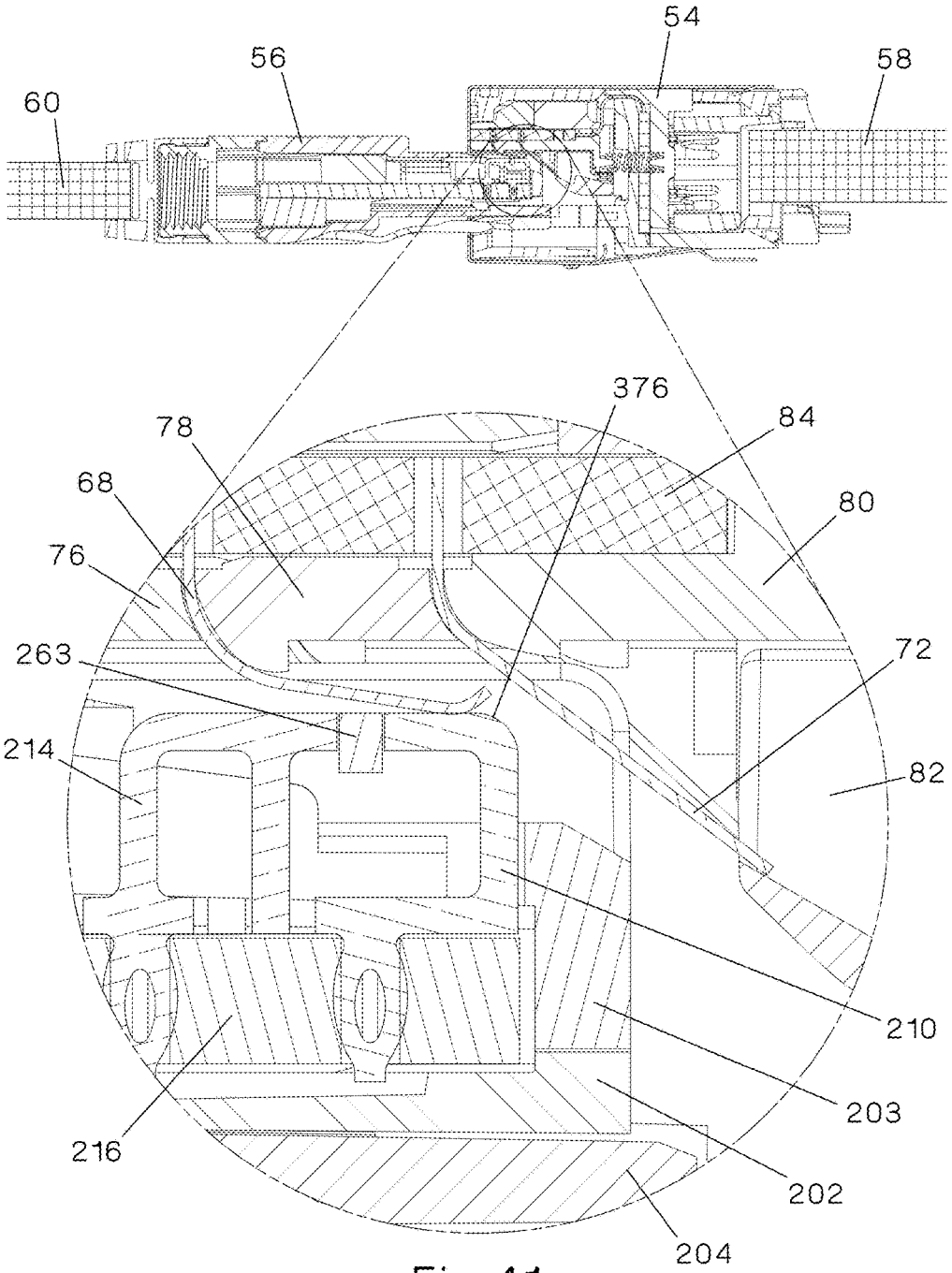
FIG. 41 is a cross-sectional view about line 41-41 of FIG. 40 showing the shielded RJ45 network jack and the shielded RJ45 plug assembly in the released state.

FIG. 40 is a top isometric view of mated assembly of shielded RJ45 network jack 54 and shielded RJ45 plug assembly 56 and respective cables 58 and 60 in a released state. The release state is a state where all rear odd PICs 72 and rear even PICs 74 have disconnected from respective plug contacts, and front odd PICS 68 and front even PICS 70 are just about to release from respective plug contacts of shielded RJ45 plug assembly 56 if any more retraction of shielded RJ45 plug assembly 56 is done. In the release state sled assembly 66 is in the fully forward state approximately 0.021" forward from the mated state. FIG. 41 is a cross-section view, taken along section line 41-41 from FIG. 40 across the mating interface of shielded RJ45 network jack 54 and shielded RJ45 plug assembly 56 in the release state. In the release state, an electrical discharge occurs roughly at discharge point 376 due to a disconnection as the current path through the shielded RJ45 network jack 54 has been broken. No electrical discharge ever occurs on rear odd PICs 72 and rear even PICs 74 as they are never the last point of connection.

Note that cable 58 and 60 are shown as shielded cable but may be any other non-limiting form of cable including, but not limited to, F/UTP or UTP cabling. Also, although shielded RJ45 network jack 54 utilizes multiple PICs per each conductor, variations of this can be done such as just utilizing multiple PICs per each conductor on conductor pairs 3-6 and 4-5.

Note that while the present disclosure includes several embodiments, these embodiments are non-limiting, and there are alterations, permutations, and equivalents, which fall within the scope of this invention. Additionally, the described embodiments should not be interpreted as mutually exclusive, and should instead be understood as potentially combinable if such combinations are permissive. It should also be noted that there are many alternative ways of implementing the embodiments of the present disclosure. It is therefore intended that claims that may follow be interpreted as including all such alterations, permutations, and equivalents as fall within the true spirit and scope of the present disclosure.

The invention claimed is:

1. A communications plug, comprising:

a conductive shell; and a printed circuit board (PCB) assembly positioned at least partially in the conductive shell, the PCB assembly comprising:

a PCB orientated parallel relative to a longitudinal direction of the conductive shell; and a plurality of plug contacts attached to the PCB, the plurality of plug contacts comprising:

a first subset of plug contacts, each of the first subset of plug contacts to mate with two plug interface contacts (PICs) of a mating communications jack; and second, third, and fourth subsets of plug contacts, each of the second, third, and fourth subsets of plug contacts to mate with at least one PIC of the mating communications jack, wherein the plurality of plug contacts forms a first plane of mating interfaces and a second plane of mating interfaces, the first plane of mating interfaces being on a different plane than the second plane of mating interfaces, and the first plane of mating interfaces is formed from the first and second subsets of plug contacts.

2. The communications plug of claim 1, wherein each of the first subset of plug contacts is T-shaped.

3. The communications plug of claim 2, wherein each of the second subset of plug contacts is C-shaped.

4. The communications plug of claim 3, wherein each of the third and fourth subsets of plug contacts are upside-down U-shaped.

5. The communications plug of claim 1, wherein the first and second subsets of plug contacts attach to the PCB in a first row of vias in the PCB.

6. The communications plug of claim 5, wherein the third subset of plug contacts attach to the PCB in a second row of vias in the PCB.

7. The communications plug of claim 6, wherein the fourth subset of plug contacts attach to the PCB in a third row of vias in the PCB.

8. The communications plug of claim 1, wherein the second plane of mating interfaces is formed from the first, third, and fourth subsets of plug contacts.

9. A communications jack, comprising:

a jack housing; and a sled assembly positioned at least partially in the jack housing, the sled assembly comprising:

a printed circuit board (PCB); and a plurality of plug interface contacts (PICs) secured within a front section of the PCB, the plurality of PICs comprising first, second, third, and fourth different rows of PICs, wherein a first pair of PICs including a first PIC of the first row of PICs and a first PIC of the third row of PICs, the first pair of PICs to mate with a same first plug contact of a mating communications plug; and a second pair of PICs including a first PIC of the second row of PICs and a first PIC of the fourth row of PICs, the second pair of PICs to mate with a same second plug contact of the mating communications plug.

10. The communications jack of claim 9, wherein:

a third pair of PICs including a second PIC of the first row of PICs and a second PIC of the third row of PICs, the third pair of PICs to mate with a same third plug contact of the mating communications plug; and a fourth pair of PICs including a second PIC of the second row of PICs and a second PIC of the fourth row of PICs, the fourth pair of PICs to mate with a same fourth plug contact of the mating communications plug.

11. The communications jack of claim 10, wherein:

a third and a fourth PIC of the first row of PICs, a third and a fourth PIC of the second row of PICs, a third and a fourth PIC of the third row of PICs, and a third and a fourth PIC of the fourth row of PICs all mate with different plug contacts of the mating communications plug.

12. The communications jack of claim 9, wherein:

the PCB is a rigid-flex PCB having a front rigid section, a rear rigid section, and a flexible section connecting the front rigid section to the rear rigid section; and the plurality of PICs are secured within the front rigid section of the rigid-flex PCB.

13. The communications jack of claim 12, wherein:

the first row of PICs attaches to a first row of vias in the front rigid section;

the second row of PICs attaches to a second row of vias in the front rigid section;

the third row of PICs attaches to a third row of vias the front rigid section; and the fourth row of PICs attaches to a fourth row of vias in the front rigid section.

14. The communications jack of claim 9, wherein the sled assembly comprises:

a middle sled holder having mandrels to maintain a bend radius of the first and second rows of PICs; and a back sled holder having mandrels to maintain a bend radius of the third and fourth rows of PICs.

15. A communications system, comprising:

a communications plug, comprising a first and a second plug contact;

a communications jack, comprising a first and a second plug interface contact (PIC); wherein, when the communications plug and the communications jack are mated:

the first plug contact and the first PIC are in contact at a first plug/jack interface, and the second plug contact and the second PIC are in contact at a second plug/jack interface;

the first plug/jack interface forms a first current path between the communications plug and the communications jack, and the second plug/jack interface forms a second current path between the communications plug and the communications jack; and a signal propagating between the communications plug and the communications jack is split in the communications plug between the first current path and the second current path, and recombined in the communications jack after the first and the second plug/jack interfaces.

* * * * *